US009827770B2

(12) United States Patent
Takei

(10) Patent No.: US 9,827,770 B2
(45) Date of Patent: Nov. 28, 2017

(54) RECORDING APPARATUS

(71) Applicant: SEIKO EPSON CORPORATION, Tokyo (JP)

(72) Inventor: Atsushi Takei, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/123,226

(22) PCT Filed: Feb. 3, 2015

(86) PCT No.: PCT/JP2015/000480
§ 371 (c)(1),
(2) Date: Sep. 1, 2016

(87) PCT Pub. No.: WO2015/136831
PCT Pub. Date: Sep. 17, 2015

(65) Prior Publication Data

US 2017/0066245 A1 Mar. 9, 2017

(30) Foreign Application Priority Data

Mar. 14, 2014 (JP) ..... 2014-051286

(51) Int. Cl.
*B41J 2/175* (2006.01)
*B41J 29/02* (2006.01)
*B41J 29/13* (2006.01)

(52) U.S. Cl.
CPC ..... *B41J 2/175* (2013.01); *B41J 2/1752* (2013.01); *B41J 2/17553* (2013.01); *B41J 29/02* (2013.01); *B41J 29/13* (2013.01)

(58) Field of Classification Search
None
See application file for complete search history.

(56) References Cited

U.S. PATENT DOCUMENTS

2014/0043392 A1 2/2014 Suzuki et al.

FOREIGN PATENT DOCUMENTS

| | | |
|---|---|---|
| JP | 2013-046987 | 3/2013 |
| JP | 2013-121659 | 6/2013 |
| JP | 2014-034187 | 2/2014 |

OTHER PUBLICATIONS

Machine Translation of JP2013046987, Takeuchi, Hiroshi et al., "Inkjet Recording Device", Mar. 7, 2013, Seiko Epson Corp, Paragraphs 0035-0038, 0041, 0045-0058.*
ISR and Written Opinion dated Apr. 21, 2015 for PCT/JP2015/000480.

* cited by examiner

*Primary Examiner* — Lisa M Solomon
(74) *Attorney, Agent, or Firm* — Workman Nydegger

(57) ABSTRACT

Provided is a recording apparatus including a recording head which is supported by a carriage that moves back and forth and performs recording by ejecting liquid on a recording medium, a supply tube which guides liquid in the liquid container body to the recording head and the recording head side thereof is follows and deformed in response to the back and forth movement of the recording head, and a dividing member which vertically divides the supply tube. The supply tube has a first portion which is folded back by the dividing member and a second portion which is folded back by the dividing member forward to the head side more than the first portion, follows and is deformed.

8 Claims, 19 Drawing Sheets

(a)

(b)

RECORDING APPARATUS

TECHNICAL FIELD

The present invention relates to a recording apparatus, for example, an ink jet printer.

BACKGROUND ART

As a recording apparatus, an apparatus is known. The apparatus is provided with a case, which contains a liquid container body containing ink, on an outer side of a housing. Inner side of the housing is provided with a recording head (for example, refer to PTL 1). In such a recording apparatus, a supply tube is connected to the liquid container body which is contained in the case, and is guided into the housing to be connected to the recording head. The recording head performs recording on a medium such as paper by ejecting ink supplied from the liquid container body on the medium.

CITATION LIST

Patent Literature

PTL 1: JP-A-2013-121659

SUMMARY OF INVENTION

Technical Problem

In the recording apparatus, since the case is provided on the outer side of the housing, the supply tube is required to route in the housing. In other words, a space where the supply tube routes is provided in the housing; therefore, there is a problem in that the larger size of the space causes the larger size of the housing. However, in a case where the space for routing the supply tube is small, a part of the supply tube may interfere another part of the supply tube in response to a movement of a carriage in a serial-type recording apparatus in which a recording head is supported by the carriage which moves in a scanning direction. In addition, if a movement area for the supply tube according to the movement of the carriage and a routing area for the supply tube connected to the liquid container body are arranged in the same surface in the housing, required area becomes larger and the size of housing becomes larger.

In addition, in some cases, electrical wire routes in the vicinity of the supply tube in the housing. In these cases, in a case where the supply tube follows and is deformed in response to a movement of the carriage, there is a concern that the supply tube which follows and is deformed may interfere the electrical wire.

An object of the present invention is to provide a recording apparatus in which it is possible for the supply tube to route in a small space, or to suitably route in the housing without interference with an electrical wire. The supply tube is for supplying liquid in a liquid container body on an outer side of a housing.

Solution to Problem

The present invention provides a recording apparatus including a recording head which is supported by a carriage that moves back and forth and performs recording by ejecting liquid on a recording medium, a supply tube which guides liquid in the liquid container body to the recording head and the recording head side thereof follows and deformed in response to the back and forth movement of the recording head, and a dividing member which vertically divides the liquid supply tube. The liquid supply tube has a first portion which is folded back by the dividing member and a second portion which is folded back by the dividing member forward to the head side more than the first portion, follows and is deformed.

According to the configuration, a space in a housing is divided into an upper part and a lower part by the dividing member. The first portion folded back by the dividing member of the supply tube is positioned in any one of an upper side area and a lower side area than the dividing member and the second portion which follows and is deformed is positioned in the other area between the upper side area and the lower side area. Therefore, the dividing member makes the portion which follows and is deformed in accordance with the back and forth movement of the carriage and the folded back portion not to interfere with each other. In addition, since a routing area of the folded back portion is positioned in a vertical direction of the movement area of the portion which follows and is deformed, an area in a vertical direction of the movement area of the portion which follows and is deformed may be actively used.

In the recording apparatus, a relay unit is provided in the housing. In this case, it is preferable that the first portion be a first supply tube which connects the liquid container body and the relay unit, and the second portion be a second supply tube which connects the relay unit and the recording head.

According to the configuration, it is possible to avoid the interference between the second supply tube which follows and is deformed in accordance with the movement of the carriage in a scanning direction and the first supply tube which does not follow and is not deformed in accordance with the movement of the carriage in a scanning direction, by the dividing member.

In the recording apparatus, it is preferable that a liquid container unit which has a case containing the liquid container body be provided on the outer side of the housing and an electrical wire connected to the liquid container unit be provided in the dividing member. According to the configuration, by providing the electrical wire in the dividing member, it is possible to prevent interference between the electrical wire and the supply tube in the housing.

In the recording apparatus, it is preferable that the dividing member have a first dividing member and a second dividing member, and the electrical wire is provided in a gap between the first dividing member and the second dividing member. According to the configuration, it is possible to provide the electrical wire in the dividing member with ease.

In the recording apparatus, it is preferable that the first dividing member and the second dividing member be made of metal. According to the configuration, it is possible to prevent electric noise from being superimposed on signals that flow through the electrical wire.

The recording apparatus may include a case which contains the liquid container body. In this case, the case is attached to a side wall positioned on one end in the width direction of the recording medium to be recorded in the housing containing the carriage, and the relay unit is provided on the other end side in the width direction in the housing.

According to the configuration, in the housing, the first supply tube routes from one end to the other end in the width direction in the housing. Even in a case where the first supply tube routes from one end to the other end in the housing, the area where the first supply tube is provided and the area where the second supply tube is provided are divided by the dividing member; therefore, it is possible for the first supply tube to route in the housing without being disturbed by the second supply tube.

It is preferable that the recording apparatus includes another case which is provided on the outer side of the housing and on the side opposite to the case interposing the housing therebetween, and another supply tube which supplies liquid in a liquid container body contained in another case to the recording head.

According to the configuration, the case is provided on one side of the housing and another case is provided on the other side of the housing. In this case, the supply tube connected to the liquid container body contained in the case routes from one end to the other end in the width direction in the housing. Therefore, it is possible to suitably avoid interference by the dividing member between the second supply tube and the first supply tube which configure the supply tube.

On the premise that the recording apparatus includes a housing, a recording head which is supported by a carriage which moves back and forth in the housing, and performs recording by ejecting liquid on a recording medium, a supply tube which guides liquid in a liquid container body to the recording head, and an electrical wire which routes in the housing, the object of the invention may be achieved. In a case where a vertical direction is the direction which intersects with a recording surface of the recording medium in which recording is performed by the recording head, the recording apparatus further includes a dividing member vertically dividing the housing. The supply tube is provided on any one of an upper area and a lower area than the dividing member and the electrical wire is provided on the other area between the upper area and the lower area.

According to the configuration, the space in the housing is divided into upper area and lower area. The supply tube is provided on any one of an upper area and a lower area than the dividing member and the electrical wire is provided on the other area between the upper area and the lower area. Therefore even the supply tube follows and is deformed in accordance with the movement of the carriage in a scanning direction, the dividing member prevents the supply tube and the electrical wire from interfering each other. Accordingly, the supply tube for supplying liquid in the liquid container body on the outer side of the housing to the recording head can suitably route in the housing.

In the recording apparatus, it is preferable that the liquid container unit having the case containing the liquid container body be provided on the outer side of the housing, and the electrical wire be guided into the housing from the liquid container unit. According to the configuration, it is possible to prevent interference between the electrical wire guided into the housing from the liquid container unit and the supply tube in the housing.

DESCRIPTION OF EMBODIMENTS

Hereinafter, an embodiment will be described with reference to FIGS. 1 to 20, in which a recording apparatus is realized into an ink jet recording apparatus.

Figure 1:
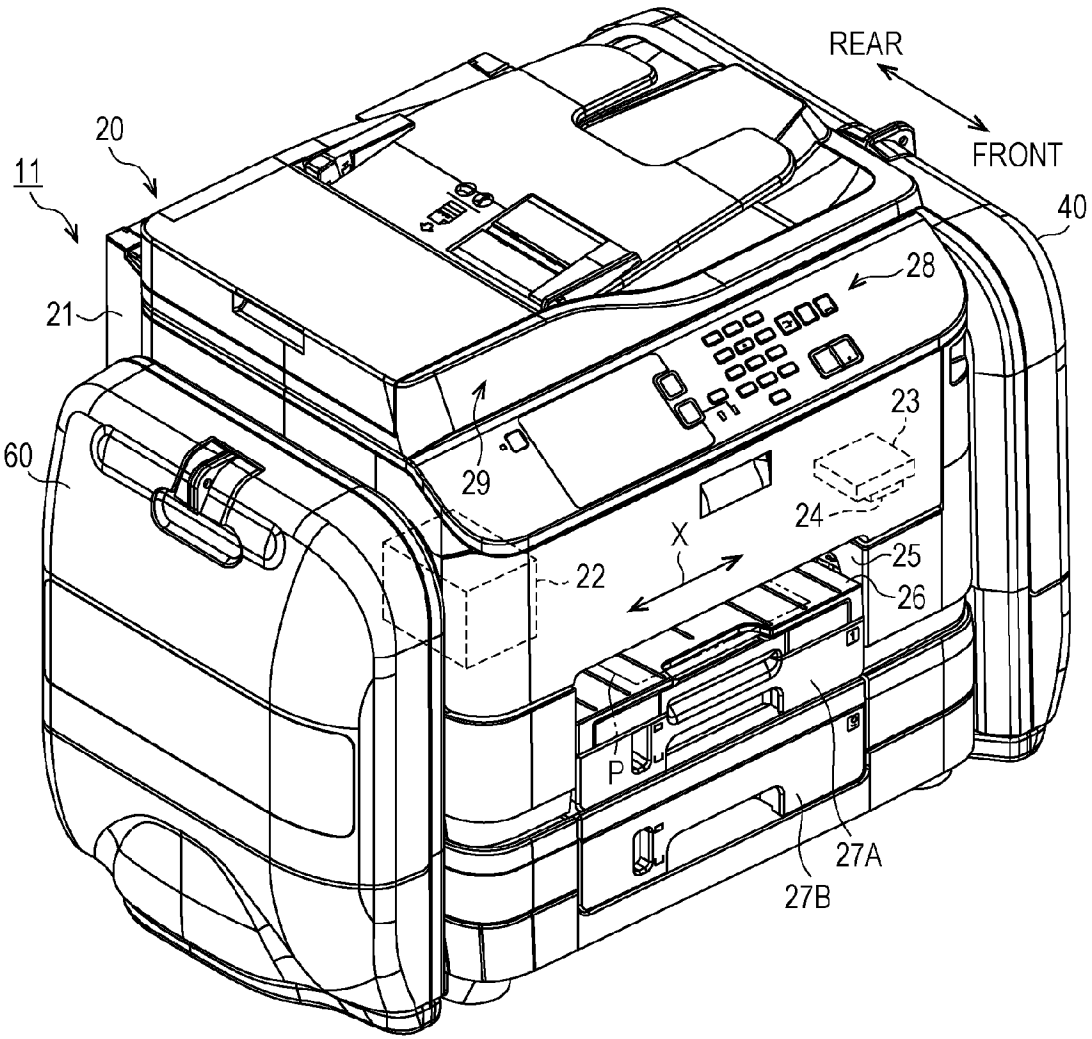
FIG. 1 is a perspective view illustrating a recording apparatus according to a first embodiment.

As illustrated in FIG. 1, a recording apparatus 11 includes a recording unit 20 for performing a recording operation on paper P that is an example of a recording medium, and two liquid container units 40 and 60 for supplying ink (an example of liquid) to the recording unit 20. The following components are provided inside a housing 21 of the recording unit 20: a relay unit 22; a carriage 23 that moves back and forth in a scanning direction X which is a lateral direction of the paper P (a recording target); and a recording head 24 supported by the carriage 23.

Figure 14:
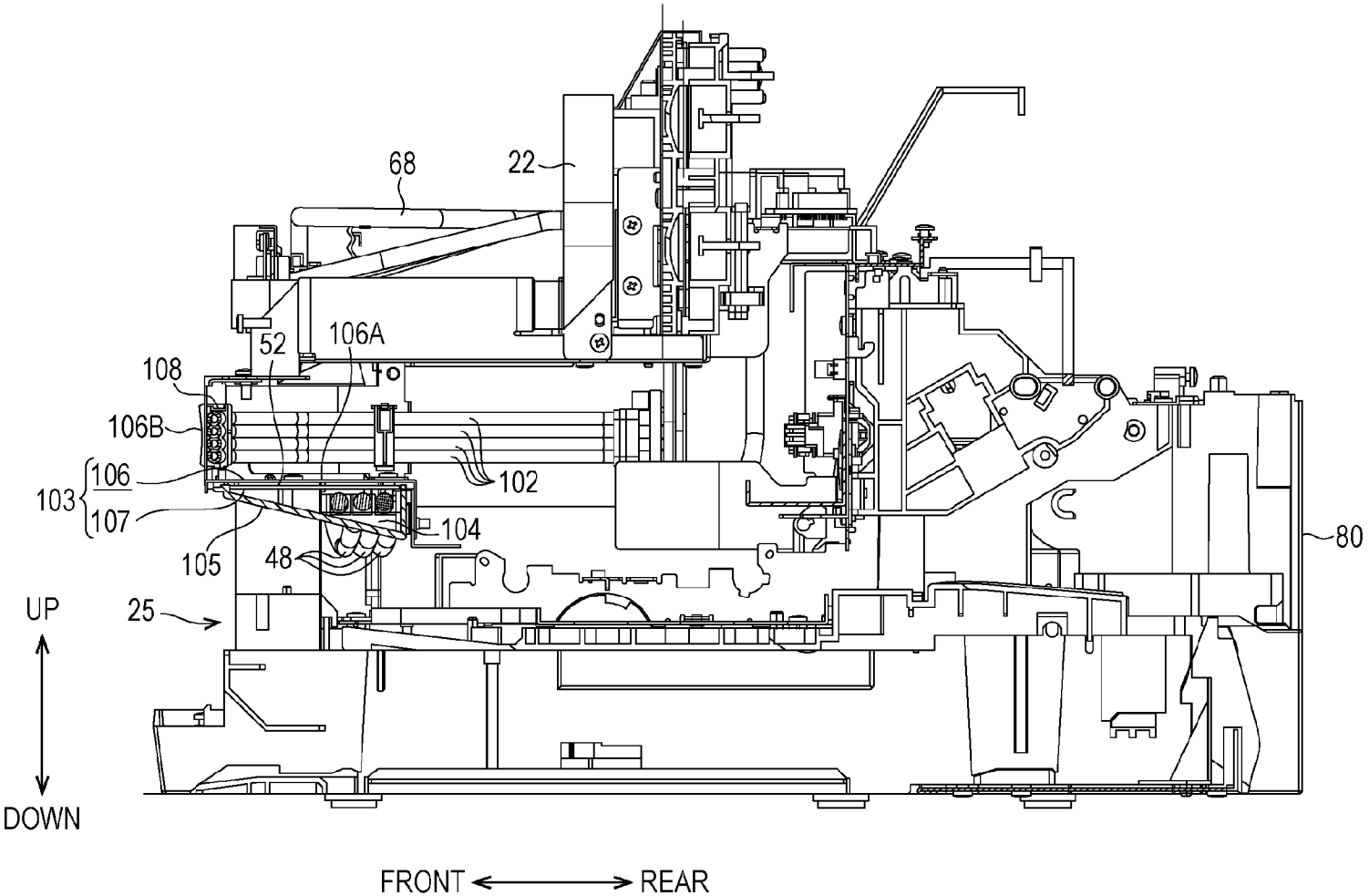
FIG. 14 is a view illustrating a state in which the partial inner space of the housing is divided into a region in which the first supply tubes are positioned, and a region in which second supply tubes are positioned.

The relay unit 22 is connected to a liquid container body 30 (refer to FIG. 3) inside the liquid container unit 40 via a first supply tube 48 (refer to FIG. 5), the liquid container body 30 (refer to FIG. 6) inside the liquid container unit 60 via a first supply tube 68 (refer to FIG. 6), and the recording head 24 via a second supply tube 102 (refer to FIG. 14). For this reason, ink contained in the liquid container body 30 is supplied to the recording head 24 via the first supply tubes 48 and 68, the relay unit 22, and the second supply tube 102.

As illustrated in FIG. 1, the relay unit 22 is disposed inside the housing 21 on an upper left side in FIG. 1, and has a buffer chamber for temporarily storing ink supplied from the liquid container units 40 and 60. Ink in the buffer chamber of the relay unit 22 is supplied to the recording head 24 via the second supply tube 102 (refer to FIG. 14). The recording head 24 records (prints) an image or the like on the paper P by ejecting the ink supplied from the relay unit 22 on the paper P. Thereafter, the recorded paper P is discharged from a discharge port 25 in a front center portion of the housing 21, and is mounted on a discharge tray 26. A "longitudinal direction" in this specification coincides with a transportation direction of the paper P on which the recording head 24 records an image or the like. In this specification, a "vertical direction" refers to a direction orthogonal to (intersecting) a recording surface of the paper P on which the recording head 24 ejects ink.

Paper supply cassettes 27A and 27B are installed vertically in two stages below the discharge tray 26 of the housing 21, and the paper supply cassettes 27A and 27B contain a plurality of pieces of papers P in a stacked state. An upper portion of the housing 21 is provided with an operation unit 28 operated by a user and a scanner device 29 for reading an image recorded on an original copy set at a set position.

The first liquid container unit 40 between the liquid container units 40 and 60 is attached to a side wall (a right side wall in FIG. 1 being separated from the relay unit 22) of side walls on opposite sides of the housing 21 in the scanning direction X. The second liquid container unit 60 is attached to a side wall (a left side wall in FIG. 1 being close to the relay unit 22) of the side walls on the opposite sides of the housing 21 in the scanning direction X.

Subsequently, the liquid container body 30 contained inside each of the liquid container units 40 and 60 will be described with reference to FIG. 2.

Figure 2:
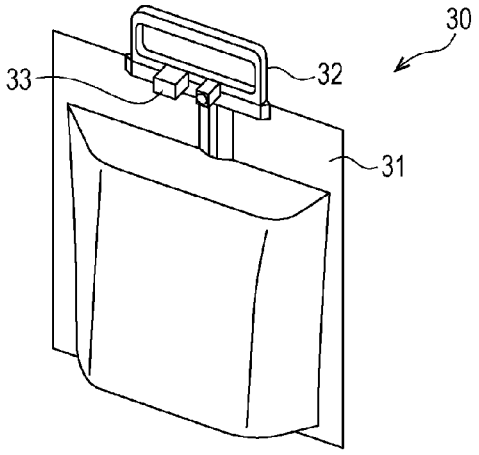
FIG. 2 is a schematic perspective view illustrating a liquid container body used in the recording apparatus.

As illustrated in FIG. 2, the liquid container body 30 has a bag-like ink bag 31 made of a flexible material, and the ink bag 31 contains ink. A rectangular annular handle portion 32 is provided at an upper end of the ink bag 31 in FIG. 2, and an IC chip 33 is provided in a connection portion between the ink bag 31 and the handle portion 32. The IC chip 33 stores information regarding ink contained in the ink bag 31, for example, information regarding the type (color or the like) of the contained ink, the amount of residual ink, and the like. When the liquid container body 30 is attached to each of the liquid container units 40 and 60 via the handle portion 32, ink in the liquid container body 30 can be supplied to the relay unit 22.

When the large-capacity liquid container body 30 is adopted, the size of each of the liquid container units 40 and 60 increases; however, since the liquid container units are respectively disposed on the opposite sides of the housing 21, it is possible to disperse the occupancy space of the liquid container units. In this case, as will be described later, the supply tube is required to take a long-distance route due to the disposition of the liquid supply units.

Subsequently, the first liquid container unit 40 will be described with reference to FIGS. 3 to 5.

Figure 3:
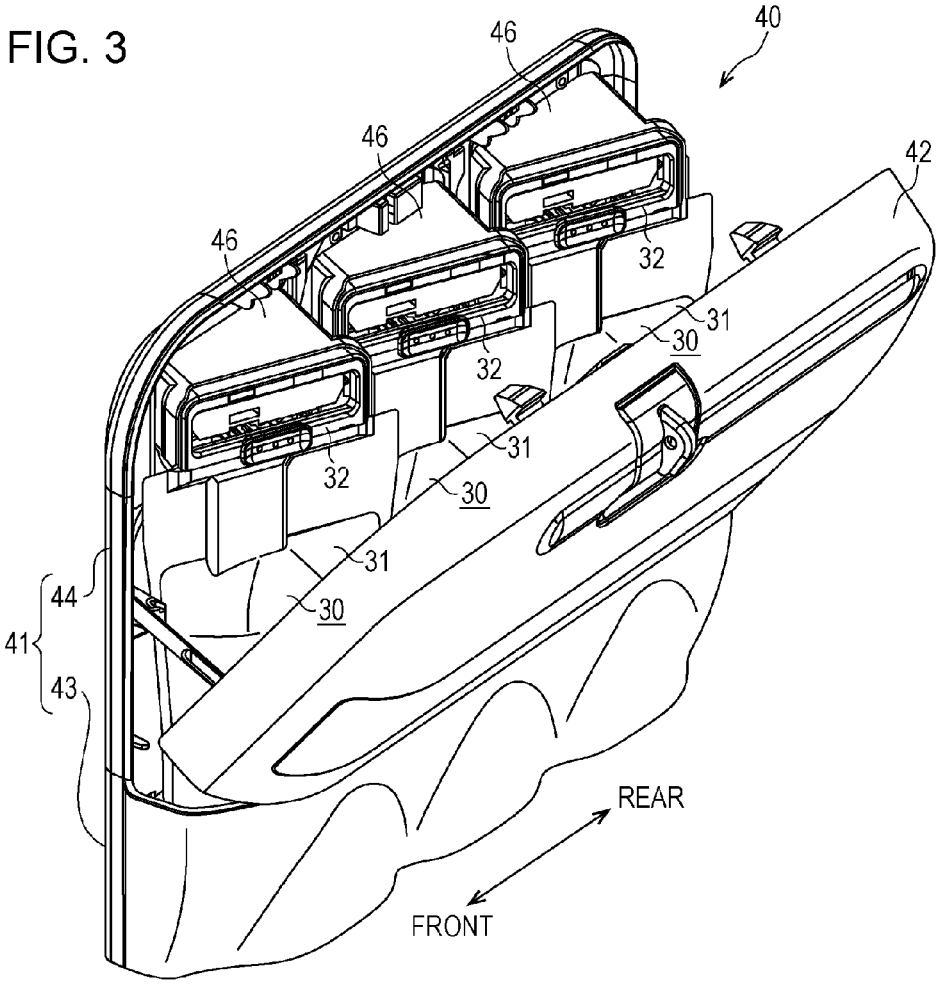
FIG. 3 is a perspective view illustrating a first liquid container unit, a cover body of which is opened.

As illustrated in FIG. 3, the first liquid container unit 40 includes a case 41 that is detachably attached to the side wall of the housing 21, and a cover body 42 that blocks an opening of the case 41. The case 41 has a bottomed box-shaped liquid container portion 43, and a side wall formation member 44 that is connected to an upper portion of a side wall of the liquid container portion 43, the upper portion facing the housing 21. Since a bottom portion of the case 41 is formed of the bottomed box-shaped liquid container portion 43, even when ink leaks within the case 41, the ink is prevented from leaking to the outside of the case 41. FIG. 5 illustrates the first liquid container unit 40 from which a guide member (not illustrated) for guiding the liquid container body 30 to a predetermined position inside the case 41 and the cover body 42 are removed.

A plurality of (three in the embodiment) support mechanisms 46 are provided in an upper portion of the side wall formation member 44, and protrude obliquely forward, and the support mechanisms 46 line up at a substantially equal interval therebetween in the longitudinal direction. A containing space formed by the case 41 and the cover body 42 contains a plurality of (here, three) of the liquid container bodies 30 which line up in the longitudinal direction and contain different types (colors) of ink, respectively, and the liquid container body 30 is supported by the support mechanism 46 via the related handle portion 32.

Figure 4:
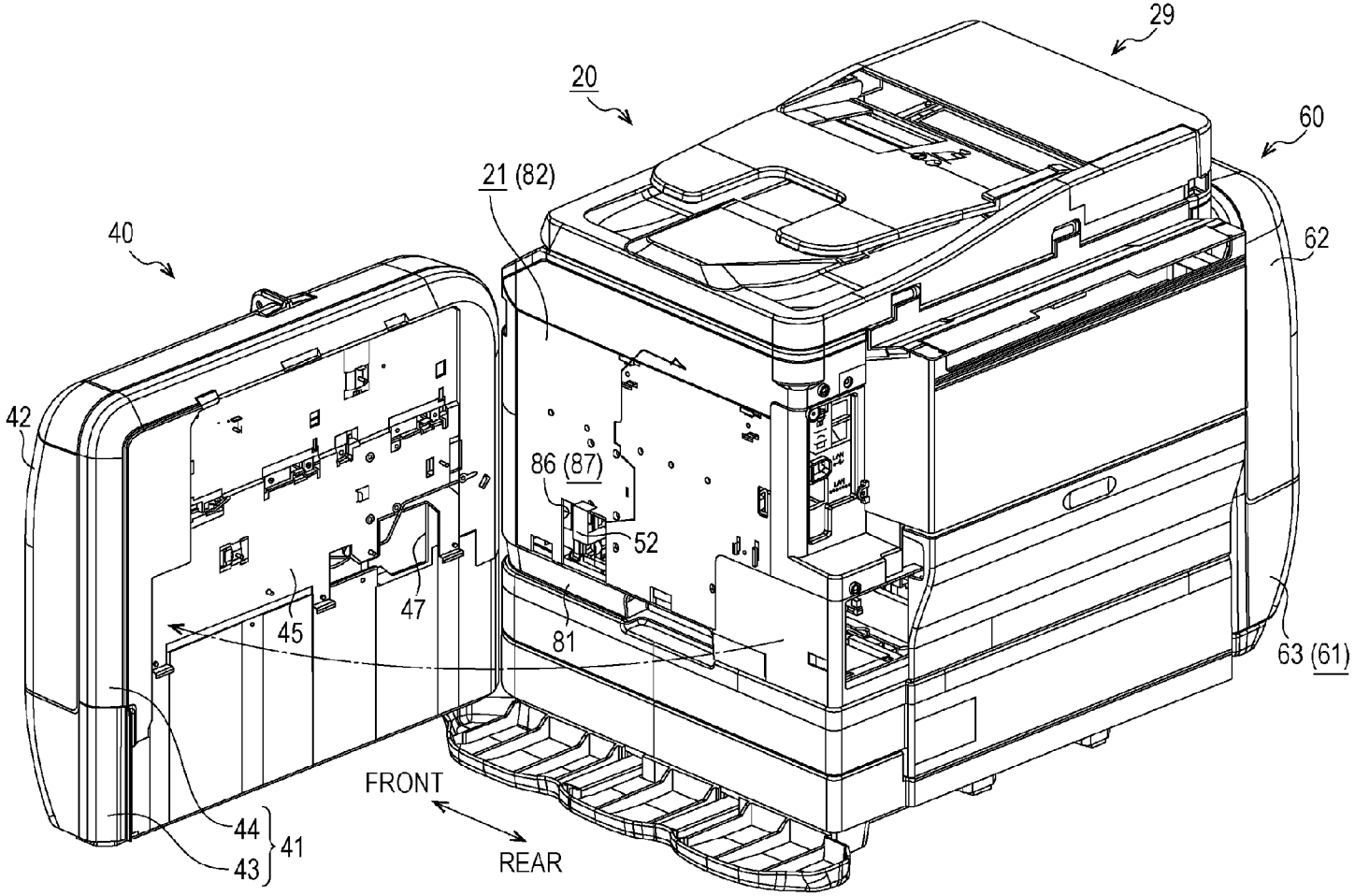
FIG. 4 is a perspective view illustrating a turn state of the first liquid container unit.

In contrast, as illustrated in FIG. 4, an attachment plate 45 is provided on an outer side of the side wall formation member 44, and the case 41 is attached to the housing 21 of the recording unit 20 via the attachment plate 45. When the first liquid container unit 40 is detached from the recording unit 20, the attachment plate 45 is separated from the housing 21 along with the case 41.

Figure 5:
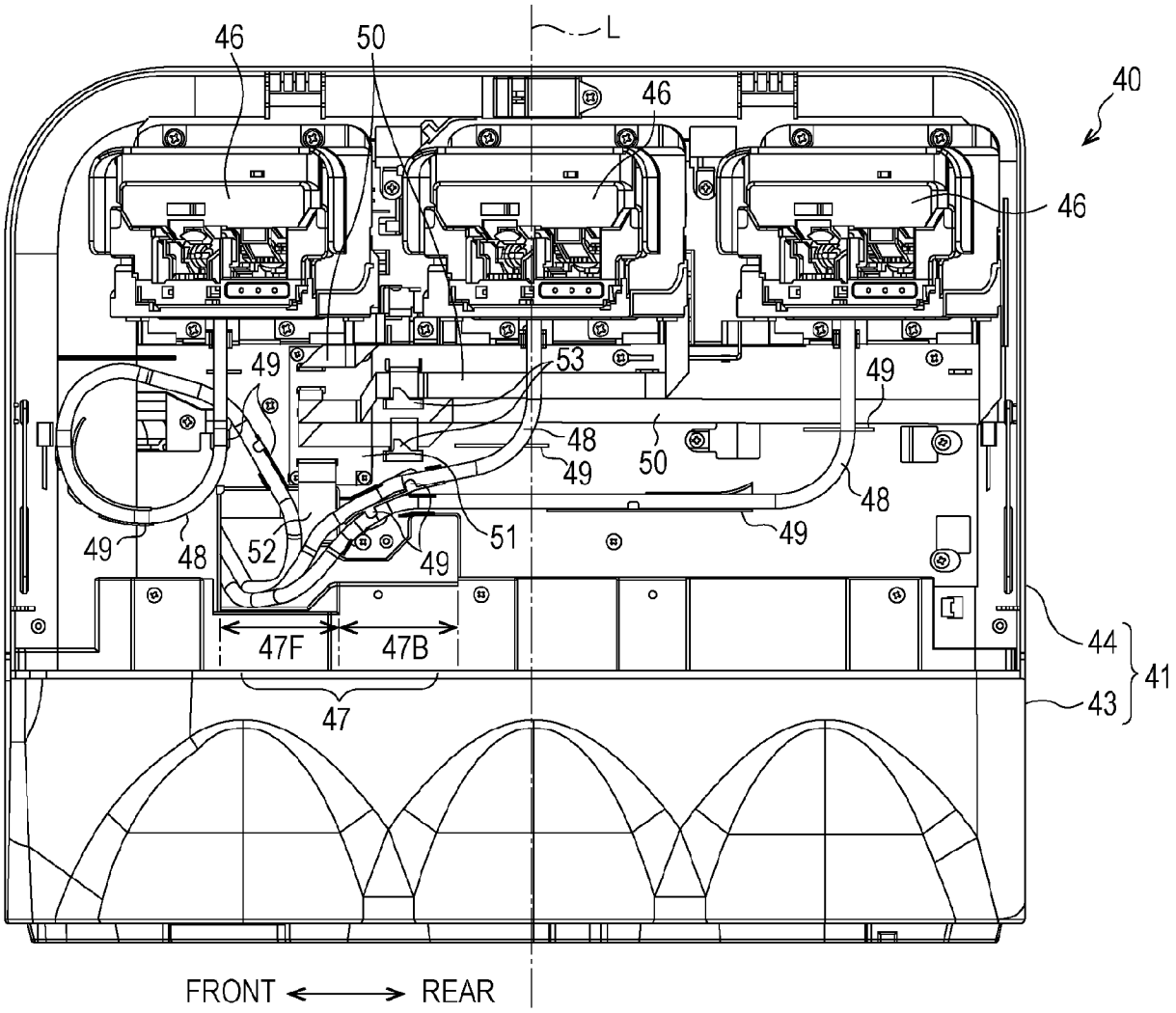
FIG. 5 is a plan view illustrating the routing of tubes and cables inside the first liquid container unit.

As illustrated in FIGS. 4 and 5, the side wall formation member 44 is provided with a through hole 47 that is an example of a second through hole through which the inside and the outside of the case 41 communicate with each other. The through hole 47 is positioned below a foremost one of the support mechanisms 46 that line up in the longitudinal direction. That is, as illustrated in FIG. 5, the through hole 47 is positioned on a front side of a center L of the case 41 in the longitudinal direction that is an example of a direction along the side wall of the housing 21 to which the case 41 is attached. The through hole 47 expands toward the center L of the case 41 in the longitudinal direction, that is, expands toward the rear of the case 41. That is, the through hole 47 is a longitudinally long hole. In this specification, a "front through hole portion 47F" refers to a front portion of the through hole 47, and a "rear through hole portion 47B" refers to a portion of the through hole 47, the portion expanding from the front portion 47F to the rear.

The liquid container body 30 supported by the support mechanism 46 is connected to one end of the first supply tube 48 for supplying ink in the ink bag 31 to the recording unit 20. The first supply tube 48 comes out of the case 41 via the front through hole portion 47F, and is guided into the housing 21 of the recording unit 20. The first supply tube 48 is connected to the relay unit 22 inside the housing 21.

The first supply tube 48 does not extend straightly toward the front through hole portion 47F inside the case 41, and while being bent, the first supply tube 48 is retained with a plurality of retainers 49 supported by the side wall formation member 44. In particular, the first supply tube 48 connected to the foremost liquid container body 30 makes one turn along the side wall formation member 44, and then is routed toward the front through hole portion 47F. When a worker deforms the retainers 49, the retaining of the first supply tube 48 with the retainers 49 can be released. When the retaining of the first supply tube 48 with the retainers 49 is released, the first supply tube 48 can be pulled out of the case 41 via the through hole 47.

An individual cable 50 is a flexible flat cable, and one end of the individual cable 50 is electrically connected to the IC chip 33 (refer to FIG. 2) of the liquid container body 30 (illustrated in FIG. 3) supported by the support mechanism 46. The individual cables 50 are also electrically connected to a rearmost one and a middle one of the liquid container bodies 30 inside the case 41, respectively, and are retained by cable retainers 53 supported by the side wall formation member 44. The individual cable 50 electrically connected to the foremost liquid container body 30 may be retained by the cable retainers similar to the other individual cables 50, or may not be retained by the cable retainers.

A relay substrate 51 is provided between the foremost support mechanism 46 and the through hole 47 in the side wall formation member 44, and the other end of the individual cable 50 is electrically connected to the relay substrate 51. One integrated cable (flexible flat cable) 52 is attachably and detachably connected to the relay substrate 51, and is electrically connected to the individual cables 50 via the relay substrate 51. The integrated cable 52 comes out of the case 41 via the front through hole portion 47F. The integrated cable 52 outside the case 41 is guided into the housing 21 of the recording unit 20, and is connected to an integrated circuit substrate 121 (refer to FIG. 19) that is provided in the vicinity of the relay unit 22 inside the housing 21. Accordingly, in the embodiment, the integrated cable 52 is equivalent to an example of an "electrical wire" connected to the first liquid container unit 40.

Only one cable (that is, the integrated cable 52) comes out of the case 41 of the first liquid container unit 40 that contains the plurality of liquid container bodies 30. For this reason, it is easy to assemble the first liquid container unit 40 to the recording unit 20 compared to the case in which all of the individual cables 50 come out of the case 41.

Subsequently, the second liquid container unit 60 will be described with reference to FIGS. 4 and 6.

Figure 6:
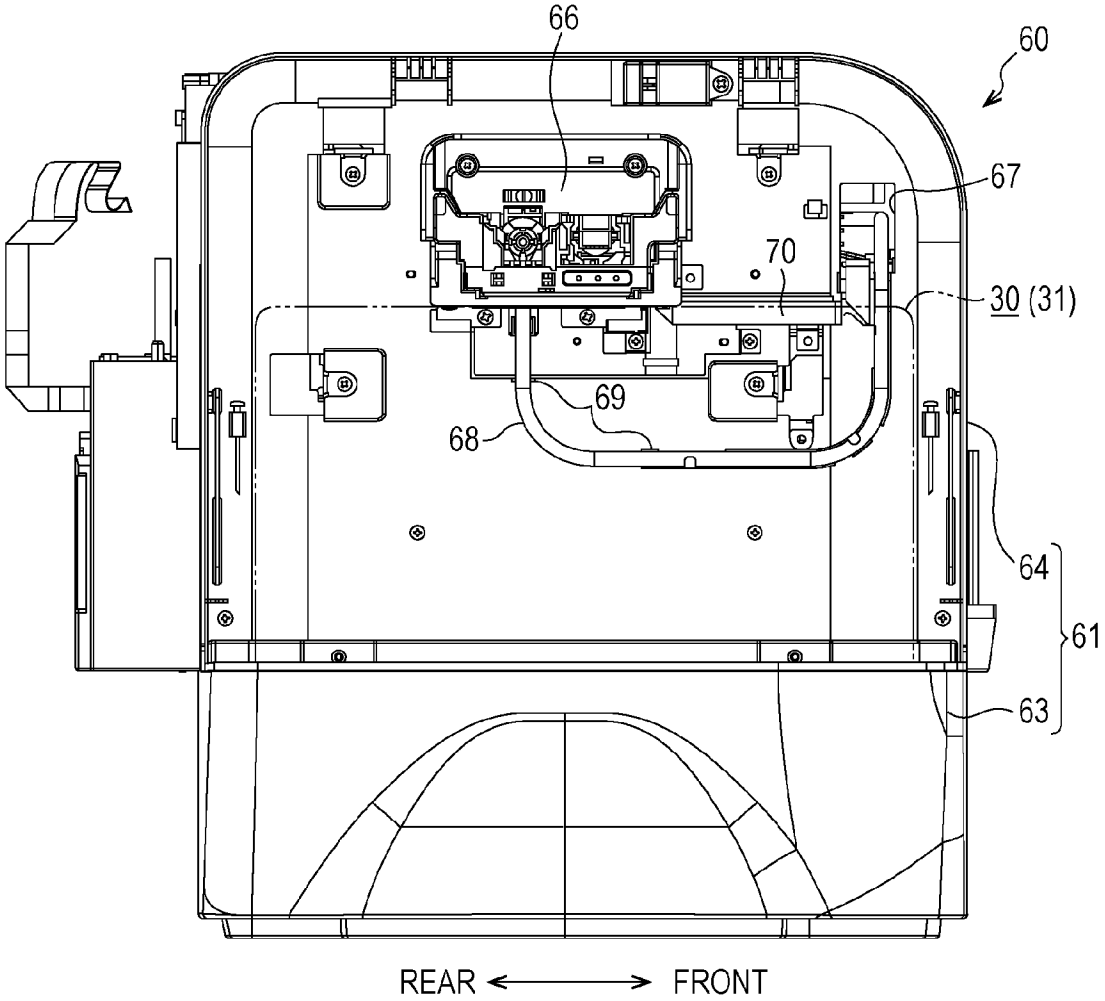
FIG. 6 is a plan view illustrating the routing of a tube and a cable inside a second liquid container unit.

As illustrated in FIGS. 4 and 6, similar to the first liquid container unit 40, the second liquid container unit 60 includes a case 61 that is an example of another case, and a cover body 62 that blocks an opening of the case 61. The case 61 has a bottomed box-shaped liquid container portion 63, and a side wall formation member 64 that is connected to an upper portion of a side wall of the liquid container portion 63, the upper portion facing the housing 21. Since a bottom portion of the case 61 is formed of the bottomed box-shaped liquid container portion 63, even when ink leaks within the case 61, the ink is prevented from leaking to the outside of the case 61. Similar to the first liquid container unit 40, an attachment plate is provided on an outer side of the side wall formation member 64, and the second liquid container unit 60 is attached to the housing 21 of the recording unit 20 via the attachment plate. FIG. 6 illustrates the second liquid container unit 60 from which a guide member (not illustrated) for guiding the liquid container body 30 to a predetermined position inside the case 61 and the cover body 62 are removed.

A support mechanisms 66 is provided in an upper portion of the side wall formation member 64. A containing space formed by the case 61 and the cover body 62 contains the liquid container body 30 for containing ink (for example, black ink), and the liquid container body 30 is supported by the support mechanism 66 via the related handle portion 32.

The liquid container body 30 supported by the support mechanism 66 is connected to one end of the first supply tube 68 for supplying ink in the ink bag 31 to the recording unit 20. The side wall formation member 64 is provided with a through hole 67 that is positioned on a front side of the support mechanism 66, and the first supply tube 68 comes out of the case 61 via the through hole 67. The first supply tube 68 does not extend straightly toward the through hole 67 inside the case 61, and while being bent, the first supply tube 68 is retained with a plurality of retainers 69 supported by the side wall formation member 64. The first supply tube 68 outside the case 61 is guided into the housing 21 of the recording unit 20, and is connected to the relay unit 22. When a worker deforms the retainers 69, the retaining of the first supply tube 68 with the retainers 69 can be released. When the retaining of the first supply tube 68 with the retainers 69 is released, the first supply tube 68 can be pulled out of the case 61 via the through hole 67.

An individual cable 70 is a flexible flat cable, and one end of the individual cable 70 is attachably and detachably, and electrically connected to the IC chip 33 of the liquid container body 30 supported by the support mechanism 66. The individual cable 70 comes out of the case 61 via the through hole 67. The individual cable 70 outside the case 61 is guided into the housing 21 of the recording unit 20, and is connected to a relay circuit substrate 120 (refer to FIG. 19) that is provided in the vicinity of the relay unit 22 inside the housing 21.

Subsequently, the recording unit 20 will be described with reference to FIG. 4 and FIGS. 7 to 11.

Figure 7:
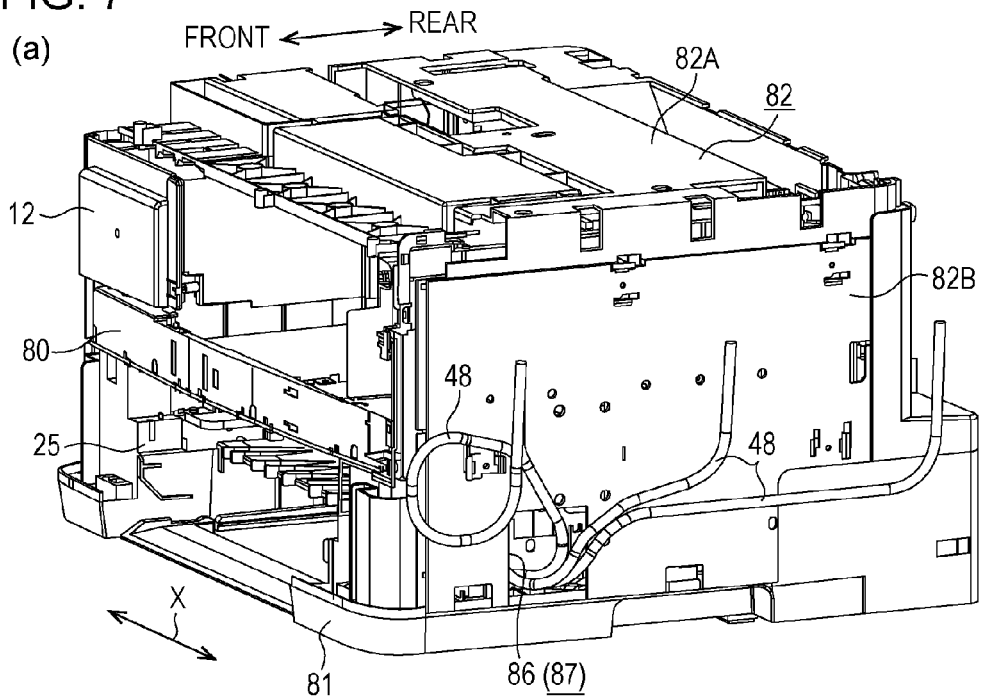
FIG. 7(*a*) is a perspective view illustrating a recording unit from which a design cover is detached, and FIG. 7(*b*) is a perspective view illustrating a cover member of a housing.
Figure 7:
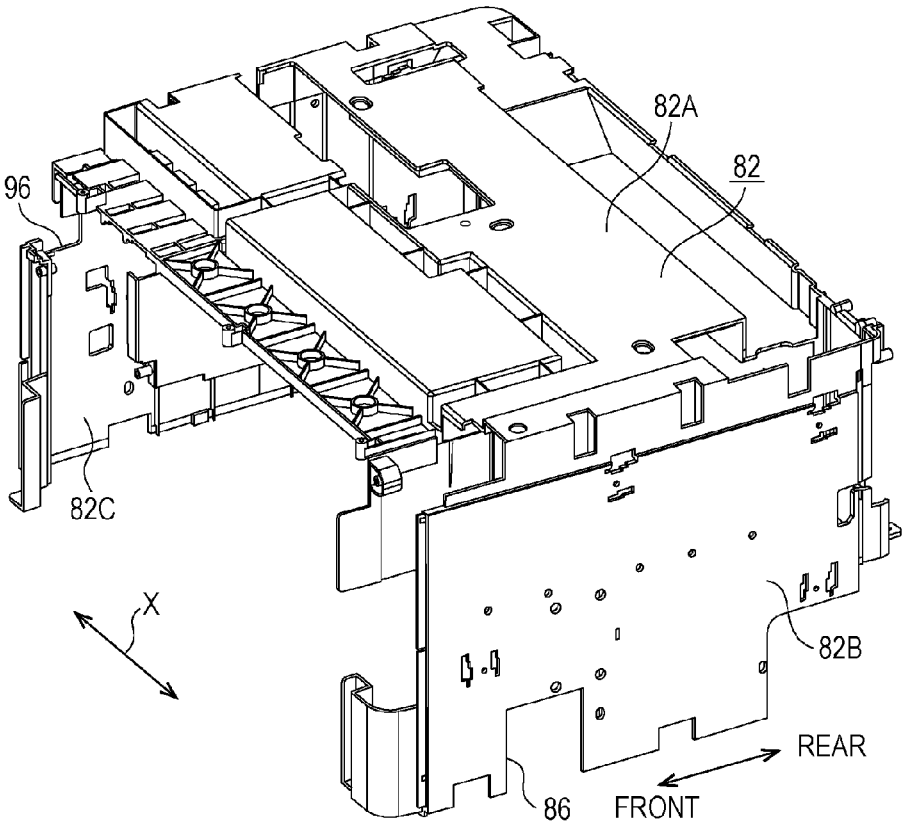

FIG. 7(*a*) illustrates the recording unit 20 from which a design cover (not illustrated) is removed. As illustrated in FIG. 7(*a*), the housing 21 of the recording unit 20 includes a housing frame 80 that contains the relay unit 22, the recording head 24, and a control device (not illustrated). A bottom wall member 81 is provided below the housing frame 80, and the housing frame 80 is covered with a cover member 82.

As illustrated in FIG. 7(*b*), the cover member 82 has a main body portion 82A that covers an upper portion of the housing frame 80, and side wall portions 82B and 82C which extend downward from opposite ends of the main body portion 82A in the scanning direction X. A tip end (lower end) of each of the side wall portions 82B and 82C is connected to the bottom wall member 81. Even when the design cover is attached to the housing 21, both of the side wall portions 82B and 82C are exposed to the outside. For this reason, the side wall portion 82B of the cover member 82 is equivalent to the side wall of the housing 21 to which the first liquid container unit 40 is attached, and the side wall portion 82C is equivalent to the side wall of the housing 21 to which the second liquid container unit 60 is attached.

Figure 8:
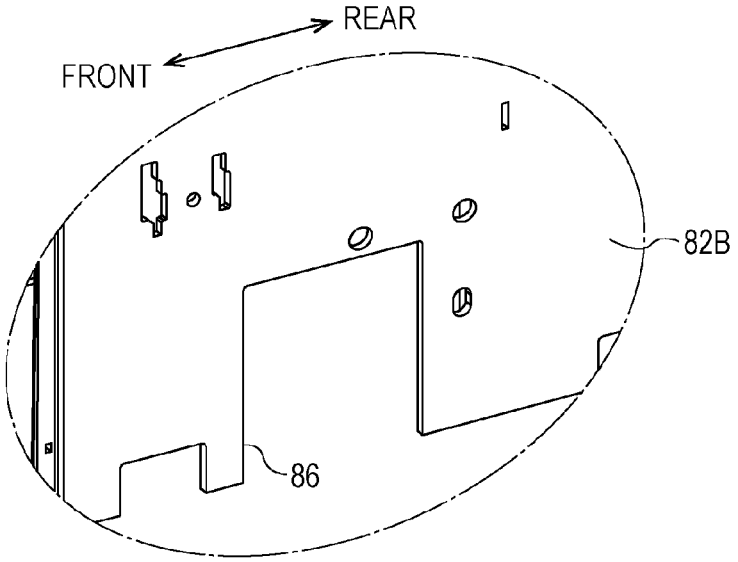
FIG. 8 is a perspective view illustrating an enlarged portion of a side wall portion of the cover member to which the first liquid container unit is attached.

FIG. 8 illustrates a part of the side wall portion 82B that faces the first liquid container unit 40. As illustrated in FIGS. 7(*b*) and 8, a cut-out portion 86 is provided in the side wall portion 82B such that a lower surface of the cut-out portion 86 is opened, and is positioned to face the front through hole portion 47F in the side wall formation member 44 of the first liquid container unit 40. The cut-out portion 86 is positioned on a front side of a longitudinal center of the side wall portion 82B.

The longitudinal length of the cut-out portion 86 is shorter than that of the through hole 47 of the first liquid container unit 40. As illustrated in FIG. 7(*a*), when the cover member 82 is attached to the housing frame 80, an opening of the cut-out portion 86 is blocked with the bottom wall member 81, and thereby a through hole 87 is formed. The first supply tubes 48 connected to the respective liquid container bodies 30 and the integrated cable 52 pass through the through hole 87. Accordingly, in the embodiment, the through hole 87 is an example of a "first through hole" through which the first supply tubes 48 pass, the first supply tubes 48 being connected to the respective liquid container bodies 30.

Here, the cover member 82 is detached from the housing frame 80 for the maintenance of the recording unit 20. When the maintenance is completed, the cover member 82 is assembled to the housing frame 80. At this time, the side wall portion 82B of the cover member 82 is provided with the cut-out portion 86, the lower surface of which is opened, and the cut-out portion 86 contains the first supply tubes 48 via the opening. For this reason, when the cover member 82 is assembled to the housing frame 80, the first supply tubes 48 and the integrated cable 52 are properly protected. It is possible to perform work in a state where the first supply tubes 48 remain connected to the relay unit 22.

Figure 9:
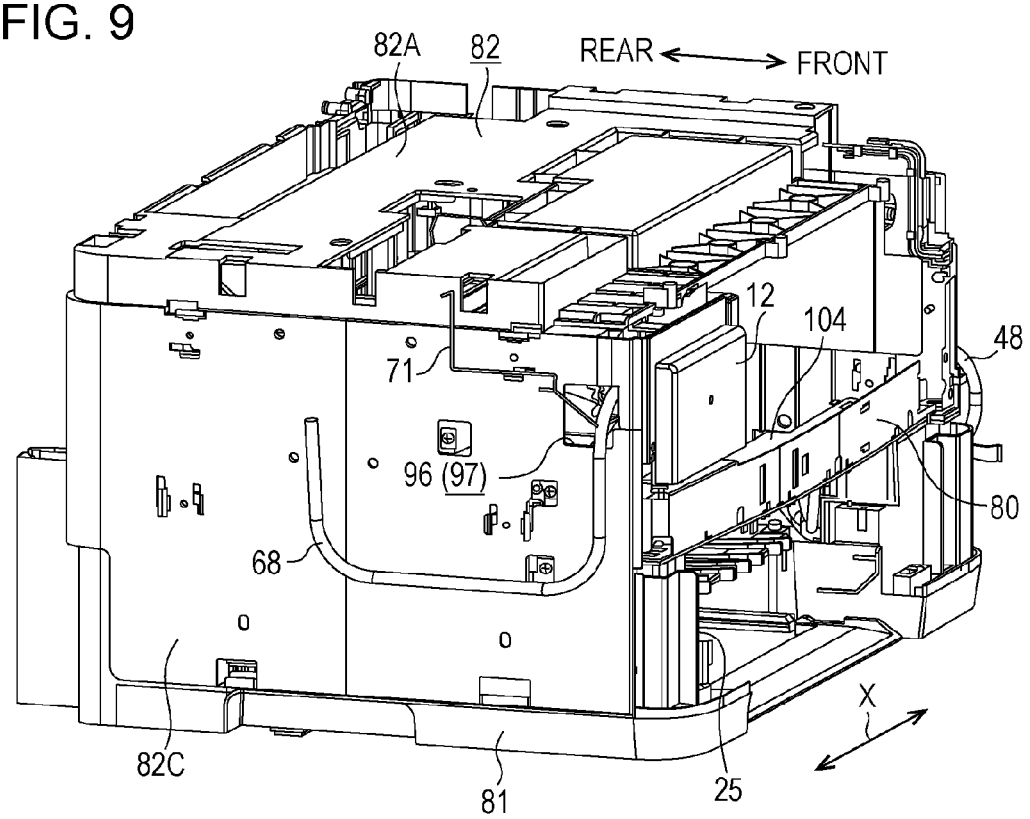
FIG. 9 is a perspective view illustrating the recording unit from which the cover member is detached.
Figure 10:
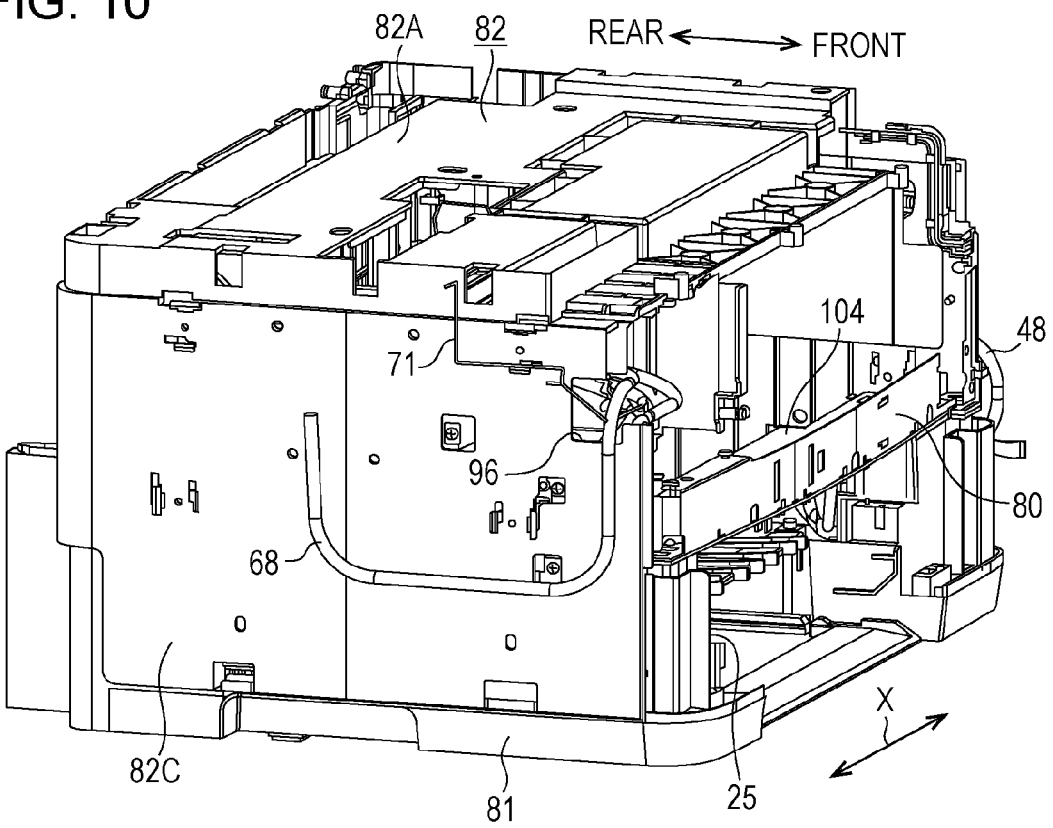
FIG. 10 is a perspective view illustrating the recording unit from which the cover member and a blocking member are detached.
Figure 11:
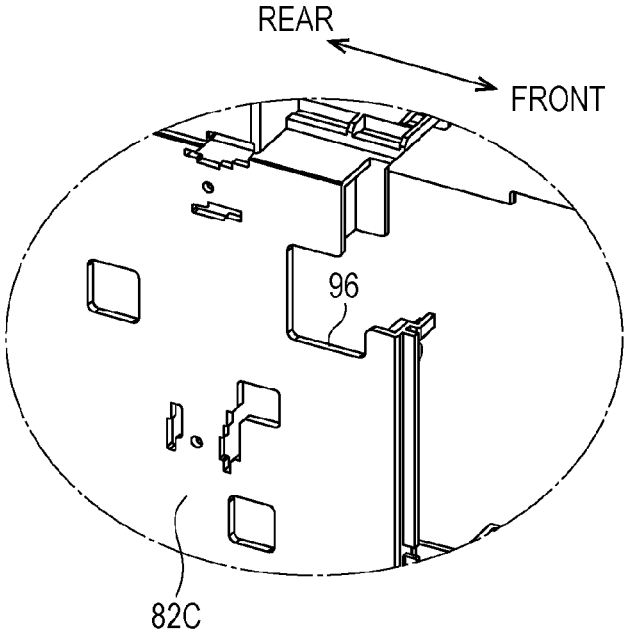
FIG. 11 is a perspective view illustrating an enlarged portion of a side wall portion of the cover member to which the second liquid container unit is attached.

FIG. 11 illustrates a part of the side wall portion 82C that faces the second liquid container unit 60. As illustrated in FIGS. 10 and 11, a cut-out portion 96 is provided in the side wall portion 82C in such a manner that the cut-out portion 96 is opened at a front end and an upper end of the side wall portion 82C, and is positioned to face the through hole 67 in the side wall formation member 64 of the second liquid container unit 60. As illustrated in FIG. 9, the cut-out portion 96 is blocked with a blocking member 12 for blocking the relay unit 22 inside the housing frame 80 from the front, and thereby a through hole 97 is formed. The first supply tube 68 connected to the liquid container body 30 and the individual cable 70 pass through the through hole 97.

The following description given with reference to FIGS. 12 to 18 is regarding a routing pattern of each of the first supply tubes 48 and the integrated cable 52 which are guided into the housing 21 from the first liquid container unit 40.

Figure 12:
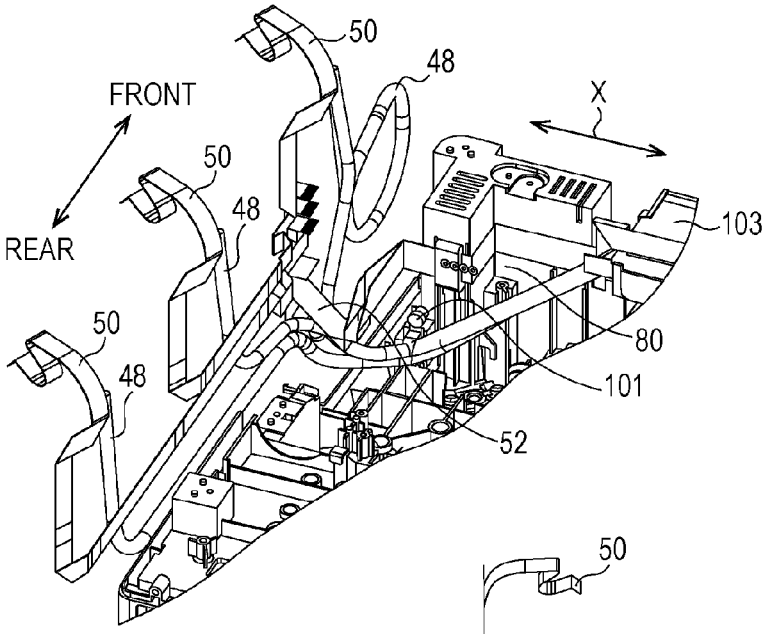
FIG. 12 is a perspective view illustrating a part of the routing of first supply tubes inside the housing.

As illustrated in FIG. 12, the first supply tubes 48 guided into the housing frame 80 via the through hole 87 are bound with a clamp member 101 that is supported by a front lower portion of the housing frame 80. For this reason, the first supply tubes 48 pass through a lower portion of the through hole 87 in the side wall of the housing 21 (refer to FIG. 7(*a*)).

The clamp member 101 is disposed on an opposite side of the relay unit 22 while the discharge port 25 is interposed therebetween in the scanning direction X. A portion of each of the first supply tubes 48 on a downstream side of the clamp member 101 is routed from one side to the other side in the scanning direction X.

Figure 13:
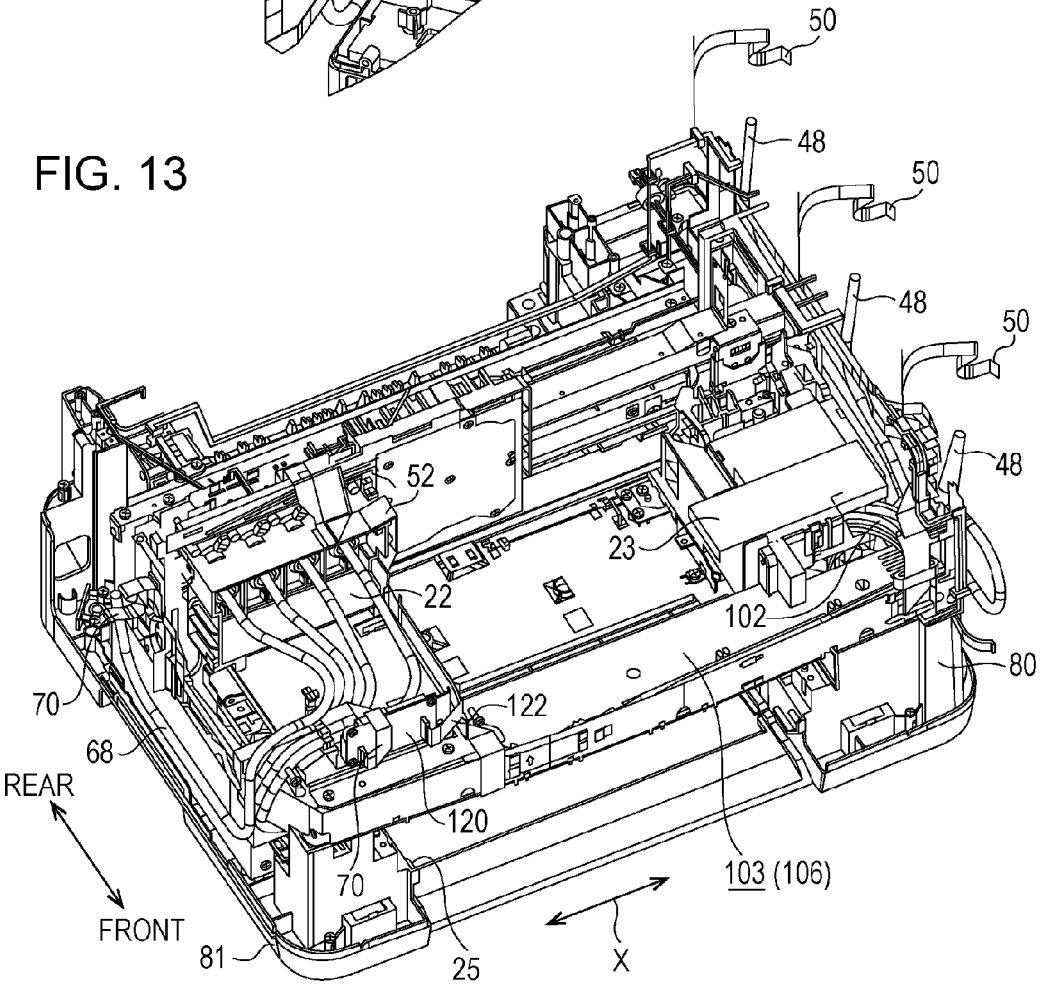
FIG. 13 is a perspective view illustrating the internal configuration of the housing.

As illustrated in FIGS. 13 and 14, a space is vertically formed between the discharge port 25 of the paper P and the second supply tube 102 for connecting the relay unit 22 and the recording head 24, and the first supply tubes 48 extend from the first liquid container unit 40 and passes through the space up to the relay unit 22.

Figure 15:
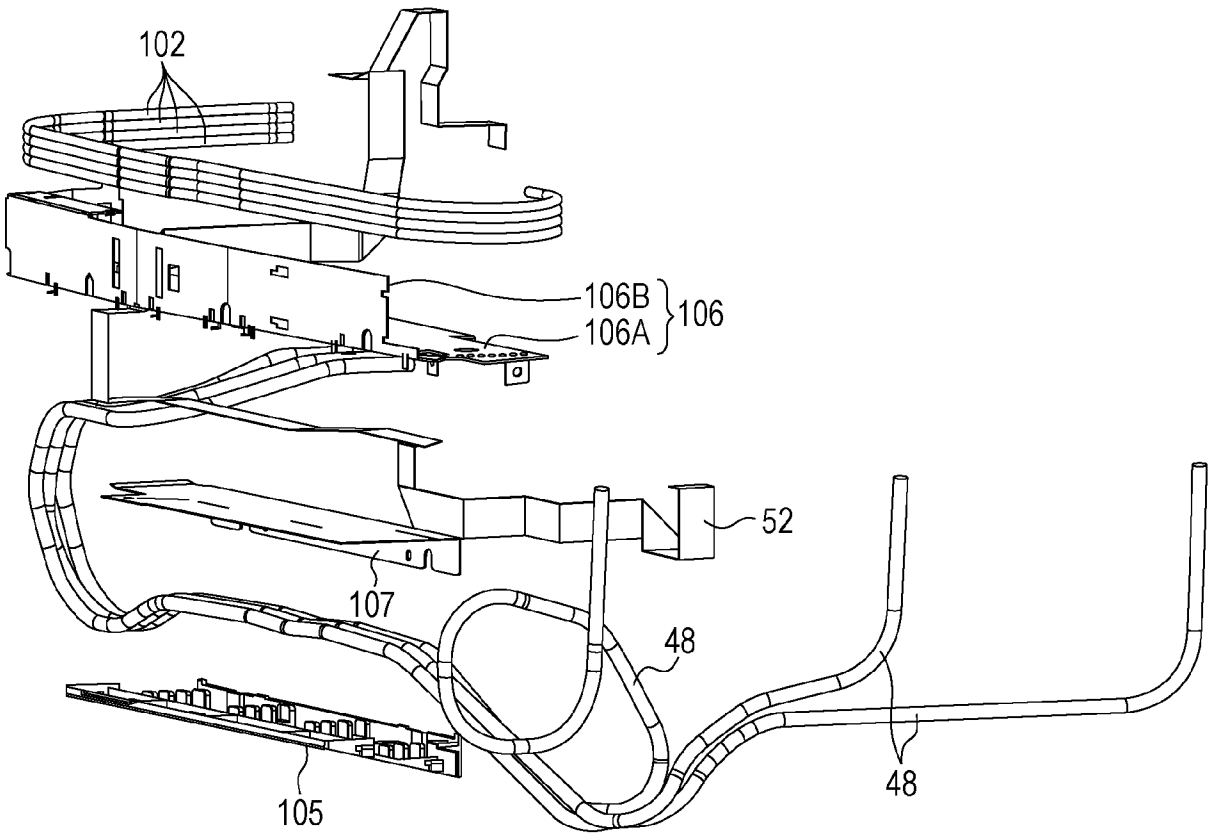
FIG. 15 is an exploded view illustrating a dividing member that divides the partial inner space into the region in which the first supply tubes are positioned and the region in which second supply tubes are positioned, and members in the vicinity of the dividing member.

That is, as illustrated in FIGS. 14 and 15, a dividing member 103 is provided between the second supply tubes 102 and the first supply tubes 48, and vertically divides a partial inner space into the following regions: region in which the second supply tubes 102 are positioned; and region in which the first supply tubes 48 are positioned in the scanning direction X. The dividing member 103 is disposed on a front side of a movement path of the carriage 23, and along the scanning direction X. That is, in a region that is ensured above the dividing member 103, the second supply tube 102 is allowed to follow and be deformed in response to a movement of the carriage 23. The first supply tube 48 positioned inside the housing 21 is equivalent to an example of an "upstream supply tube portion", and the second supply tube 102 is equivalent to an example of a "downstream supply tube portion". The first supply tube 48 and the second supply tube 102 (the second supply tube 102 being connected to the first supply tube 48 via the relay unit 22) form an example of "a supply tube" for supplying ink supplied from the first liquid container unit 40 to the recording head 24. The first supply tube 68 and the second supply tube 102 (the second supply tube 102 being connected to the first supply tube 68 via the relay unit 22) form an example of "another supply tube" for supplying ink supplied from the second liquid container unit 60 to the recording head 24.

As illustrated in FIG. 14, a space formation member 105 is attached to a lower portion of the dividing member 103, and forms a containment space 104 for the first supply tubes 48 along the scanning direction X along with the dividing member 103. The space formation member 105 is positioned above the clamp member 101. For this reason, the first supply tubes 48 are guided into the housing 21 via the through hole 87 in the side wall of the housing 21, are bent, and then enter the containment space 104. The first supply tubes 48 in the containment space 104 are supported by the space formation member 105.

As illustrated in FIGS. 14 and 15, the dividing member 103 has a first dividing member 106 and a second dividing member 107 that is disposed below the first dividing member 106. Each of the first dividing member 106 and the second dividing member 107 is made of a metallic plate-like material. The first dividing member 106 is provided with a dividing plate portion 106A orthogonal to substantially the vertical direction, and a support portion 106B that erects upward from a front end of the dividing plate portion 106A. The support portion 106B is provided with a clamp member 108 for binding the second supply tubes 102. For this reason, in the embodiment, a portion of the second supply tube 102 closer to the recording head 24 than the clamp member 108 is equivalent to a portion that follows and is deformed in response to a movement of the carriage 23 in the scanning direction X. The first supply tube 48, and a portion of the second supply tube 102 closer to the relay unit 22 than the clamp member 108 are equivalent to portions that do not follow and are not deformed in response to a movement of the carriage 23 in the scanning direction X.

The second dividing member 107 is supported by the first dividing member 106, and a small gap is interposed between the dividing plate portion 106A of the first dividing member 106 and the second dividing member 107. The integrated cable 52 is positioned in this gap, the integrated cable 52 extending from the first liquid container unit 40 to the integrated circuit substrate 121 (refer to FIG. 19) provided in the vicinity of the relay unit 22.

Figure 16:
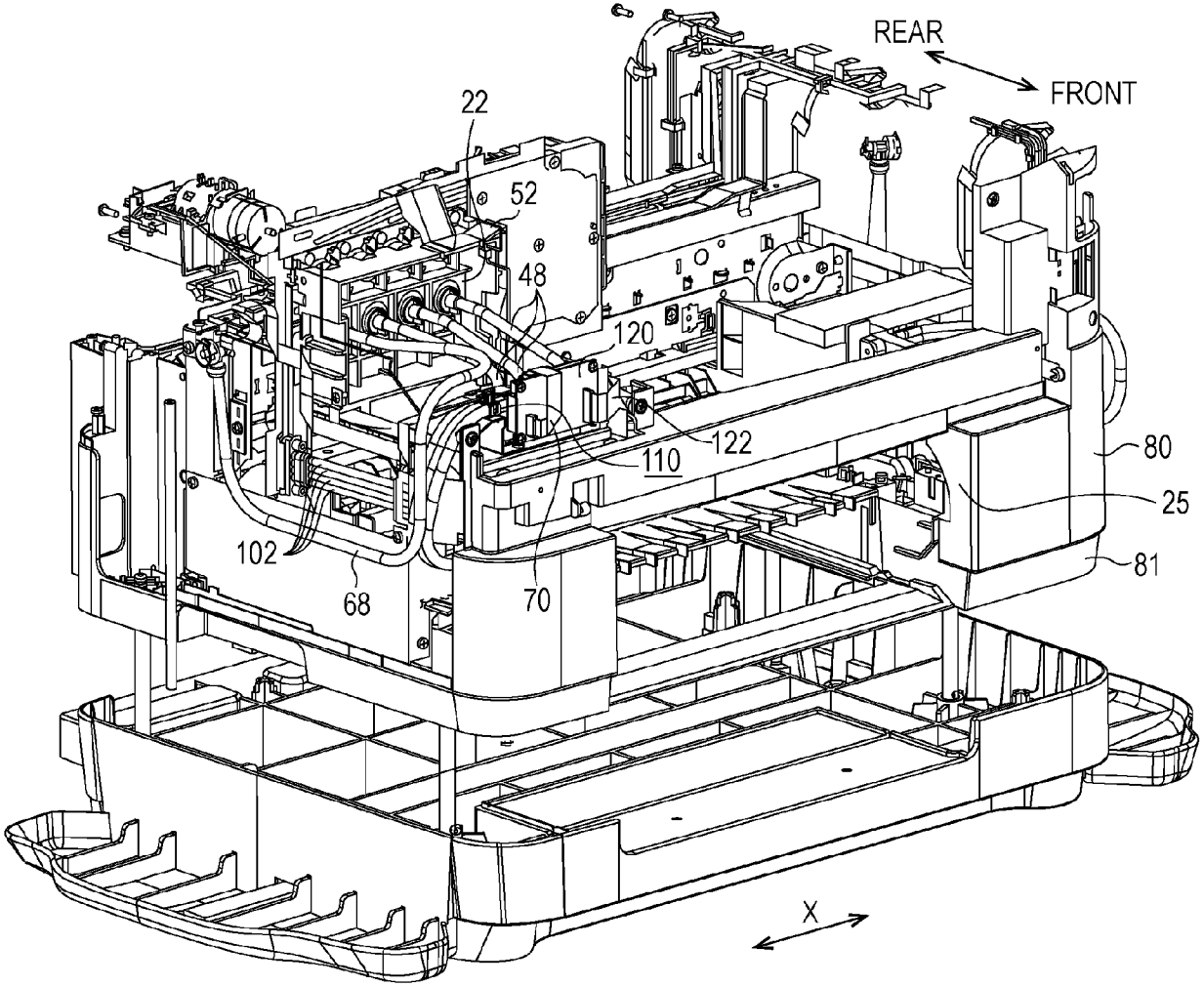
FIG. 16 is a perspective view illustrating a state in which the first supply tubes are connected to a relay unit.

As illustrated in FIG. 16, the first supply tubes 48 passing through the containment space 104 are bent upward and are connected to the relay unit 22. Connection portions between the first supply tubes 48 and 68 and the relay unit 22 are positioned higher than that between the second supply tube 102 and the relay unit 22.

Figure 17:
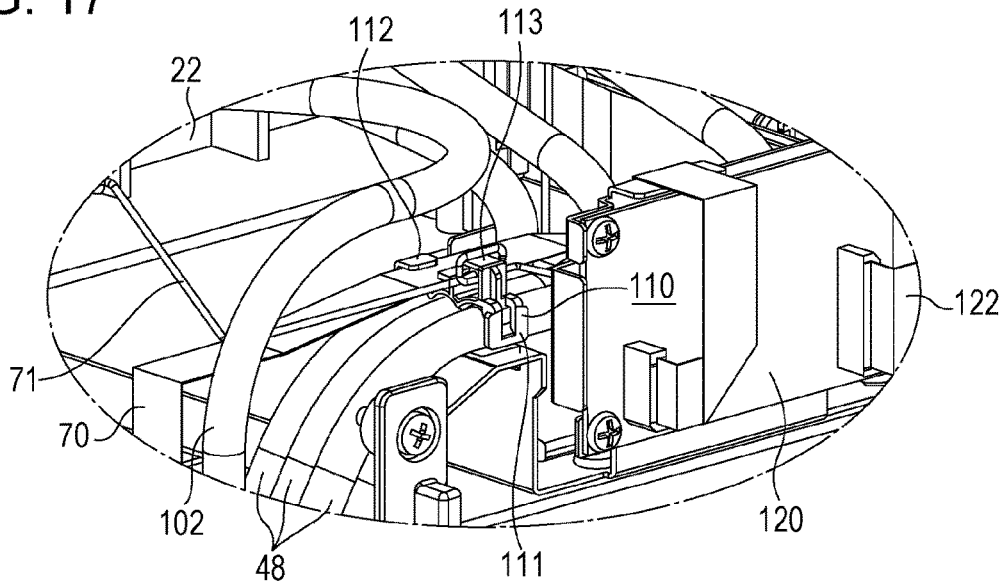
FIG. 17 is an enlarged perspective view illustrating a retainer member for binding the first supply tubes and the vicinity of the retainer member.
Figure 18:
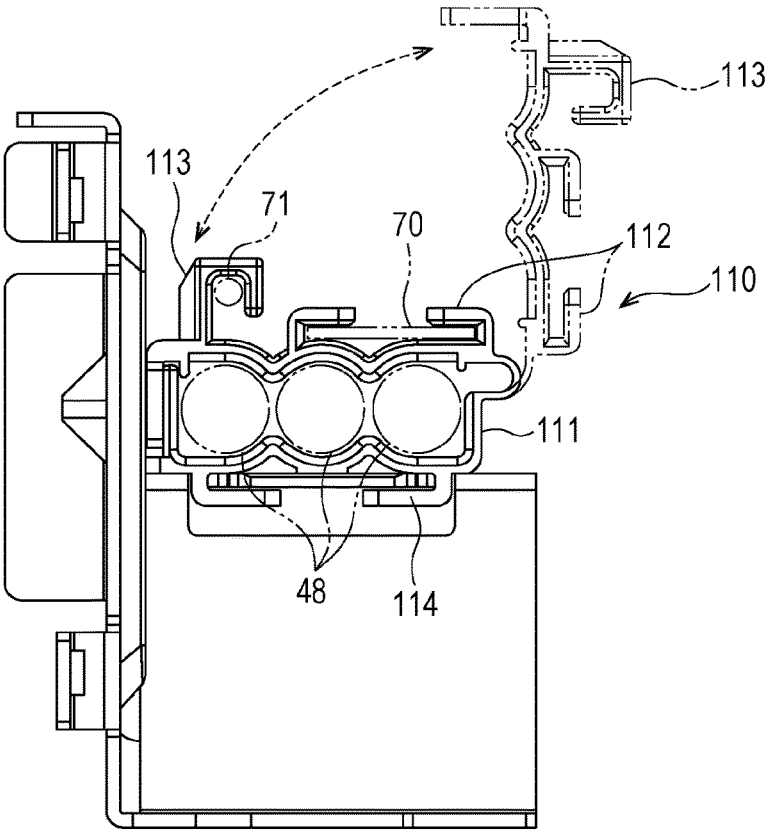
FIG. 18 is a plan view illustrating the retainer member.

As illustrated in FIGS. 17 and 18, after the first supply tubes 48 pass through the containment space 104 and are bent upward, a retainer member 110 binds the first supply tubes 48 in a region above the second supply tubes 102. The retainer member 110 has a tube retainer portion 111 for retaining the first supply tubes 48; a cable support portion 112 for supporting the individual cable 70 that is introduced from the second liquid container unit 60 into the housing 21;

a wire winding portion 113 having an electrical wire 71 extending from the second liquid container unit 60 and wound therearound. For example, the electrical wire 71 may be an electrical wire that is connected to a sensor for detecting whether the cover body 62 of the second liquid container unit 60 is opened.

As illustrated in FIG. 18, the tube retainer portion 111 can be opened and closed. That is, when the tube retainer portion 111 is opened, the first supply tubes 48 are assembled to the tube retainer portion 111. When the tube retainer portion 111 is closed in this state, the first supply tubes 48 are retained with the retainer member 110.

A leg portion 114 is provided on a lower side of the tube retainer portion 111 of the retainer member 110. The housing frame 80 slidably supports the retainer member 110 via the leg portion 114.

The following description given with reference to FIG. 15 is regarding an example of the sequence of assembling the first supply tubes 48 inside the housing 21.

As illustrated in FIG. 15, the space formation member 105 is disposed below the first supply tubes 48 routed inside the housing 21, and the first supply tubes 48 are supported by the space formation member 105. The second dividing member 107 is disposed above the first supply tubes 48, and the space formation member 105 for supporting the first supply tubes 48 are fixed to the second dividing member 107. The integrated cable 52 is fixed to an upper surface of the second dividing member 107. Subsequently, the first dividing member 106 is disposed above the second dividing member 107, and the second dividing member 107 is fixed to the first dividing member 106 in such a manner that the integrated cable 52 is interposed between the dividing plate portion 106A and the second dividing member 107.

Figure 19:
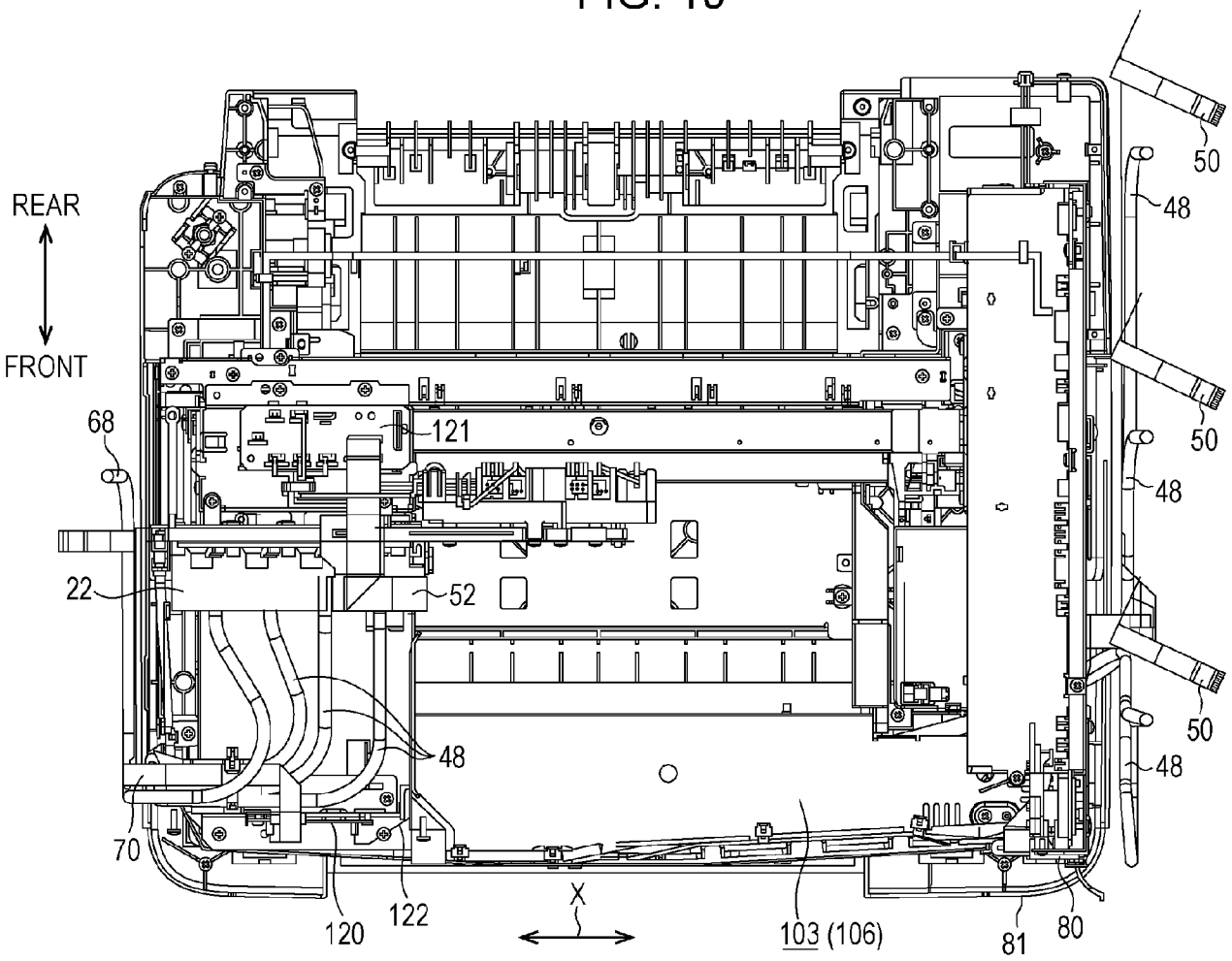
FIG. 19 is a plan view illustrating the internal configuration of the housing.

As illustrated in FIG. 19, the relay circuit substrate 120 is provided on a front side of the relay unit 22, and the individual cable 70 extends from the second liquid container unit 60 and is electrically connected to the relay circuit substrate 120. The integrated circuit substrate 121 is provided on an upper surface of a rear portion of the relay unit 22, and the integrated cable 52 extends from the first liquid container unit 40, and is electrically connected to the integrated circuit substrate 121. The integrated circuit substrate 121 is electrically connected to the relay circuit substrate 120 via a junction cable 122. The integrated circuit substrate 121 is electrically connected to the control device (not illustrated) via a cable (not illustrated). That is, various information is collected by the integrated circuit substrate 121, and is transmitted to the control device via this cable.

Figure 20:
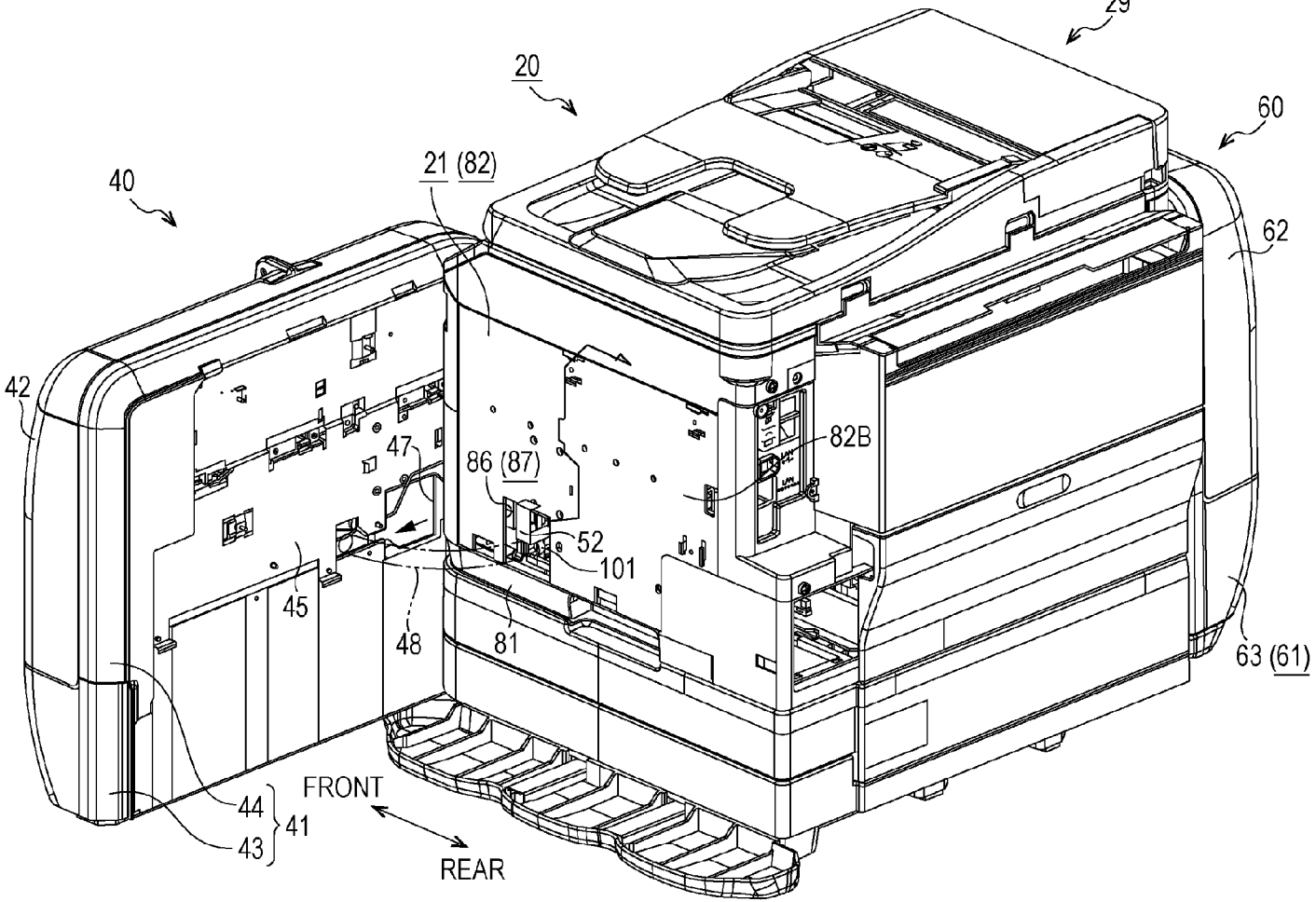
FIG. 20 is a perspective view illustrating a state in which the first liquid container unit turns relative to the housing.

The following description given with reference to FIG. 20 is regarding an operation of detaching the first liquid container unit 40 from the housing 21 and performing maintenance on the recording apparatus 11.

In the first liquid container unit 40, the retaining of the first supply tubes 48 with the retainers 49 is released, and the integrated cable 52 is detached from the relay substrate 51. In addition, bolts for attaching the first liquid container unit 40 to the housing 21 are detached. For example, in this state, the first liquid container unit 40 is slid forward with respect to the housing 21. At this time, since the through hole 47 of the case 41 is a long hole expanding rearward, even when the first supply tubes 48 are displaced rearward in the through hole 47, the first supply tubes 48 are unlikely to be in contact with a rear edge portion of the through hole 47. That is, it is possible to considerably slide the first liquid container unit 40 forward.

After the first liquid container unit 40 is slid forward to some extent, as illustrated in FIG. 20, the first liquid container unit 40 is turned relative to the housing 21 in such a manner that a rear end of the first liquid container unit 40 is separated from the housing 21. At this time, since the retaining of the first supply tubes 48 with the retainers 49 is released, the first supply tubes 48 in the first liquid container unit 40 are pulled out of the case 41 in response to the displacement of the first liquid container unit 40 relative to the housing 21, while remaining connected to the liquid container bodies 30, respectively. For this reason, it is possible to increase the amount of turning of the first liquid container unit 40. As a result, a large work space is formed on a side of the housing 21.

Moreover, prior to the turning of the first liquid container unit 40, the first liquid container unit 40 is slid forward. That is, the first liquid container unit 40 is turned in a state where a turning axis of the first liquid container unit 40 is brought closer to the through hole 47 in the case 41 of the first liquid container unit 40. For this reason, when the first liquid container unit 40 is turned, the first supply tubes 48 are pulled out of the case 41 shorter than that when the turning axis is separated from the through hole 47. That is, the first supply tubes 48 may be required not to be bent much in the case 41.

Since the distance between the turning axis and the rear end of the first liquid container unit 40 is short, even when there is a small work space in the vicinity of an installation position of the recording apparatus 11, it is possible to suitably turn the first liquid container unit 40 with respect to the housing 21. Accordingly, a worker easily performs maintenance.

The first supply tubes 48 are bound with the clamp member 101 in the housing 21. When the first liquid container unit 40 is turned, it is possible to pull the first supply tubes 48 out of the housing 21 from inside of the housing 21 by detaching the first supply tubes 48 from the clamp member 101. Accordingly, it is possible to further increase the amount of turning of the first liquid container unit 40.

According to this embodiment, it is possible to obtain the following effects.

(1) The through hole 47 in the case 41 of the first liquid container unit 40 expands to be larger than the through hole 87 in the side wall portion 82B of the cover member 82 of the housing 21. For this reason, even when the first liquid container unit 40 turns or slides forward relative to the housing 21, the first supply tubes 48 are unlikely to be caught in the through hole 47. As a result, it is possible to increase the amount of displacement of the first liquid container unit 40 relative to the housing 21 in a state where the liquid container bodies 30 contained in the first liquid container unit 40 remain connected to the relay unit 22 inside the housing 21 via the first supply tubes 48. Accordingly, it is easy to ensure a large work space between the first liquid container unit 40 and the housing 21, and it is easy to perform maintenance on the recording apparatus 11. Accordingly, it is possible to improve maintainability by displacing the first liquid container unit 40 relative to the housing 21 in a state where the liquid container bodies 30 provided on the outer side of the housing 21 remain connected to the relay unit 22 inside the housing 21 via the first supply tubes 48.

(2) The through hole 47 in the case 41 of the first liquid container unit 40 is provided on the front side of the side wall formation member 44, and expands to the rear. For this reason, even when there is a small space in the vicinity of the installation position of the recording apparatus 11, it is possible to properly turn the first liquid container unit 40 with respect to the housing 21 by sliding the first liquid container unit 40 forward relative to the housing 21 and then turning the first liquid container unit 40 in such a manner that the rear portion of the first liquid container unit 40 is separated from the housing 21. Accordingly, it is possible to increase the amount of displacement of the first liquid container unit 40 relative to the housing 21 in a state where the liquid container bodies 30 remain connected to the relay unit 22 via the first supply tubes 48.

(3) While being bent, the first supply tubes 48 in the first liquid container unit 40 are retained with the retainers 49. For this reason, it is possible to pull the first supply tubes 48 (the first supply tubes 48 being bent inside the first liquid container unit 40) out of the first liquid container unit 40 by releasing the retaining of the first supply tubes 48 with the retainers 49. As a result, it is possible to easily displace the first liquid container unit 40 in a direction in which the first liquid container unit 40 is separated from the housing 21.

(4) The dividing member 103 divides the partial inner space of the housing 21 into the following regions: region in which the first supply tubes 48 extending from the first liquid container unit 40 are positioned: and region in which the second supply tubes 102 for connecting the relay unit 22 and the recording head 24 are positioned. Accordingly, it is possible to route the first supply tubes 48 inside the housing 21 without being disturbed by the second supply tubes 102. Accordingly, it is possible to suitably route the first supply tubes 48 and the second supply tubes 102 in the housing 21, through both of which ink in the liquid container bodies 30 provided on the outer side of the housing 21 is supplied to the recording head 24. In addition, when the second supply tubes 102 follow and are deformed in response to a movement of the carriage 23, it is possible to avoid interference between the first supply tubes 48 and the second supply tubes 102 which follows and are deformed in response thereto.

(5) The integrated cable 52 is guided into the housing 21 from the first liquid container unit 40, and is connected to the integrated circuit substrate 121 disposed in the vicinity of the relay unit 22. At this time, the integrated cable 52 is disposed in the dividing member 103. For this reason, it is possible to prevent interference between the integrated cable 52 and the first supply tubes 48 or between the integrated cable 52 and the second supply tubes 102 inside the housing 21.

(6) Specifically, the dividing member 103 is formed of the first dividing member 106 and the second dividing member 107, and the integrated cable 52 is disposed between the first dividing member 106 and the second dividing member 107. Since the dividing member 103 is formed of the first dividing member 106 and the second dividing member 107, it is possible to easily realize the configuration in which the integrated cable 52 is disposed in the dividing member 103.

(7) Each of the first dividing member 106 and the second dividing member 107 is made of metal. For this reason, it is possible to prevent electric noise from being superimposed on signals that flow through the integrated cable 52.

(8) The first dividing member 106 divides the partial inner space of the housing 21 into the region in which the second supply tubes 102 are positioned, and a region in which the integrated cable 52 is positioned. For this reason, even when the second supply tubes 102 follow and are deformed in response to a movement of the carriage 23 in the scanning direction X, it is possible to avoid interference between the second supply tubes 102 and the integrated cable 52 using the first dividing member 106.

Above embodiment may be modified as follows.

Figure 21:
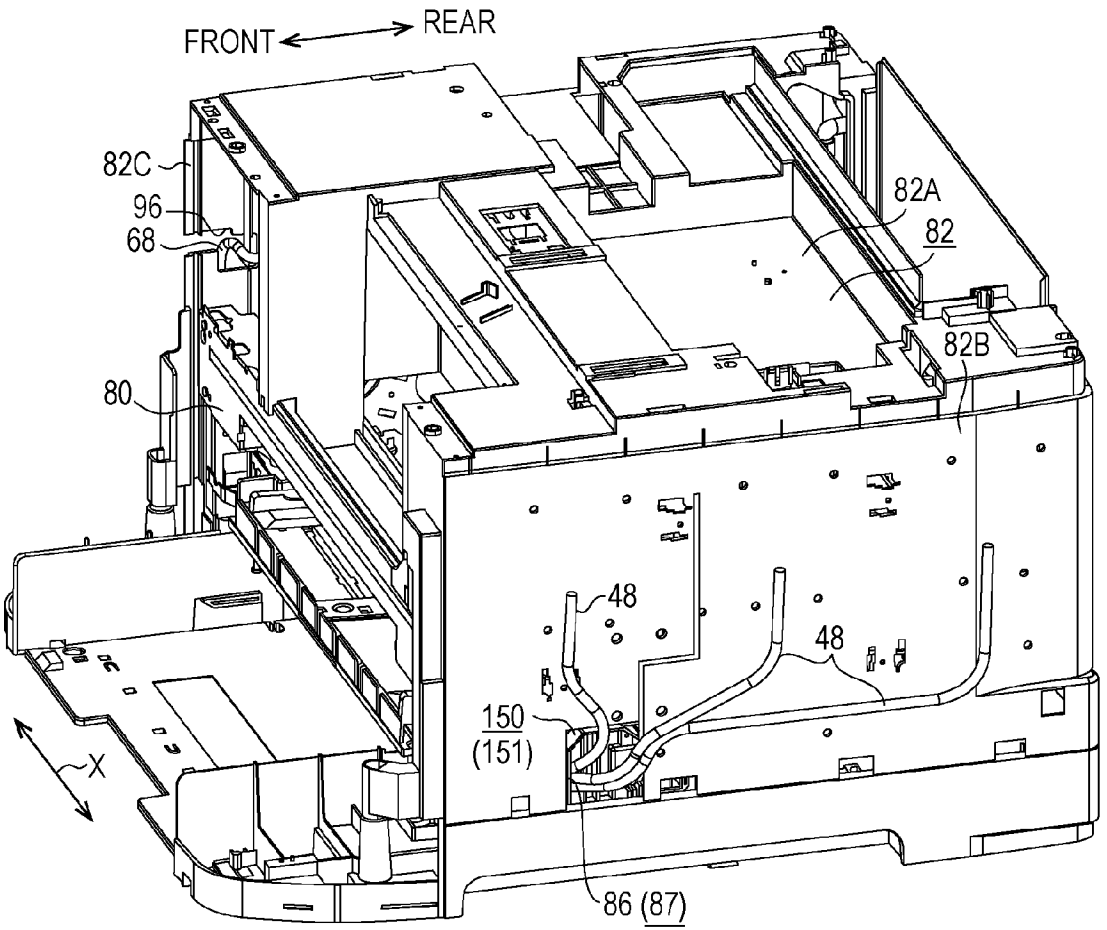
FIG. 21 is a perspective view illustrating the recording unit from which a design cover is detached in the recording apparatus according to another embodiment.
Figure 22:
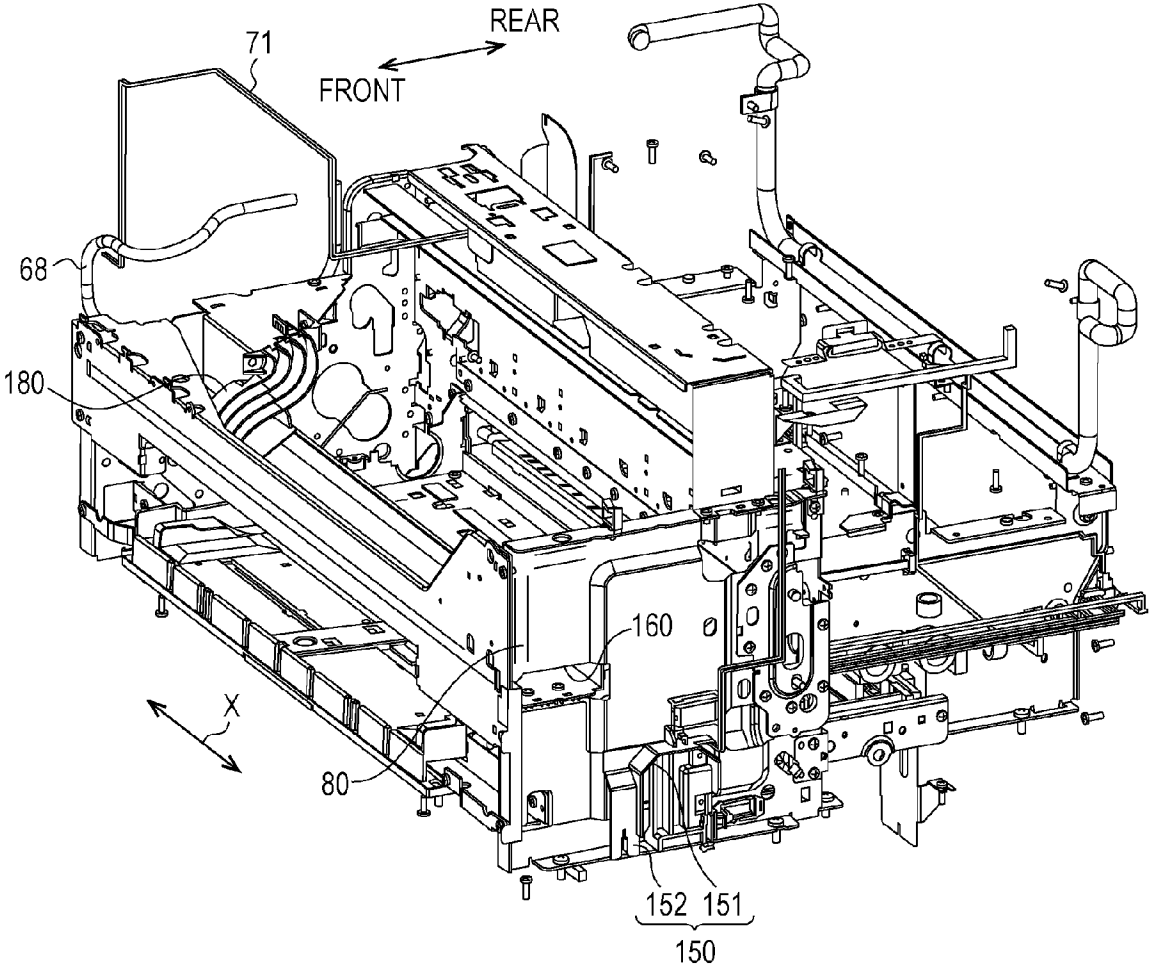
FIG. 22 is a perspective view illustrating the internal configuration of the housing in the recording apparatus according to another embodiment.

As illustrated in FIGS. 21 and 22, a tunnel member 150 is provided between the housing frame 80 and the side wall portion 82B of the cover member 82, and guides the first supply tubes 48 and the integrated cable 52 into the housing frame 80 from the first liquid container unit 40.

Figure 23:
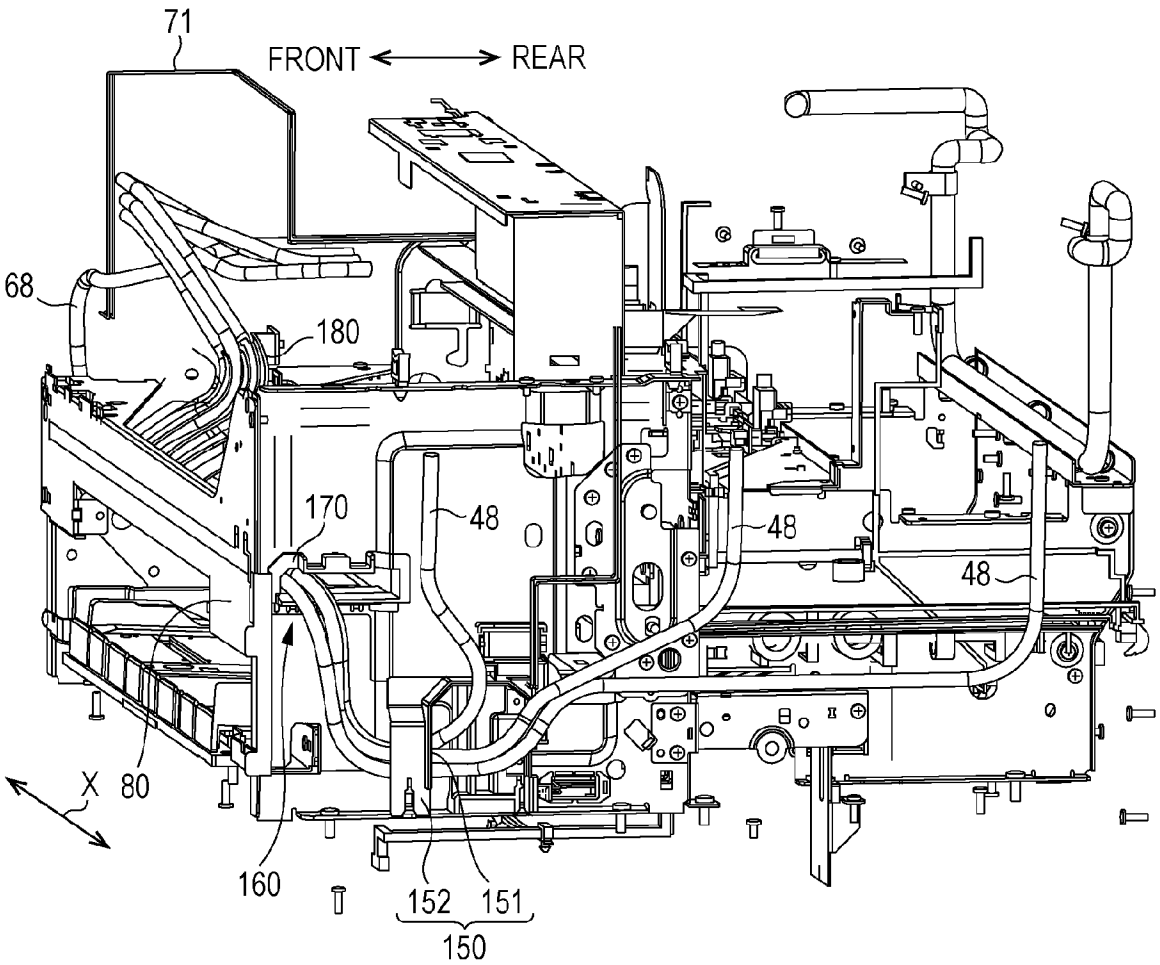
FIG. 23 is a perspective view illustrating a state in which the first supply tubes from the first liquid container unit are routed inside the housing in the recording apparatus according to another embodiment.

The tunnel member 150 is supported by the housing frame 80, has a roof portion 151 that protrudes in the scanning direction X and a spacer portion 152 that protrudes forward from the roof portion 151. The roof portion 151 has an inverted U shape having an open lower side, and passes through the through hole 87 that is formed by the side wall portion 82B of the cover member 82 and the bottom wall member 81 (refer to FIG. 21). As illustrated in FIGS. 22 and 23, after the first supply tubes 48 and the integrated cable 52 pass through the roof portion 151, the first supply tubes 48 and the integrated cable 52 pass through the spacer portion 152 communicated with the inside of the roof portion 151.

When maintenance is performed on the recording apparatus 11, the cover member 82 is detached from the housing frame 80 in a state where the liquid container bodies 30 contained in the first liquid container unit 40 remain connected to the relay unit 22 via the first supply tubes 48. At this time, when the maintenance is completed, the cover member 82 is re-attached to the housing frame 80. In another embodiment, an upper side and sides of the first supply tubes 48 are covered with the tunnel member 150, the first supply tubes 48 coming out of the case 41 of the first liquid container unit 40 and extending toward the housing frame 80. For this reason, when the cover member 82 is assembled to the housing frame 80, it is possible to prevent interference between the cover member 82 and the first supply tubes 48 by virtue of the tunnel member 150. That is, it is possible to prevent the first supply tubes 48 from being damaged.

In a case where an end portion on the side close to the relay unit 22 between opposite end portions of the dividing member 103 in the scanning direction X is positioned on inner side than the relay unit 22 in the scanning direction X, as illustrated in FIGS. 22 and 23, a bending assistance member 180 for vertically bending the first supply tube 48 may be provided on the inner side than the relay unit 22 in the scanning direction X. The first supply tubes 48 are wound around the bending assistance member 180 in such a manner as to be spiral around an axial line extending in the vertical direction. After the first supply tubes 48 are guided upward by the bending assistance member 180, the first supply tubes 48 are connected to the relay unit 22.

In the embodiment, the first supply tube 48 connected to the foremost liquid container body 30 inside the first liquid container unit 40 makes one turn and comes out of the case 41 in such a manner that the first supply tubes 48 are considerably pulled out of the case 41 when the first liquid container unit 40 is separated from the housing 21. However, insofar as it is possible to considerably separate the first liquid container unit 40 from the housing 21 for the maintenance of the recording apparatus 11, the first supply tube 48 connected to the foremost liquid container body 30 inside the case 41 of the first liquid container unit 40 may not make one turn.

Insofar it is possible to pull the first supply tubes 48 out of the housing 21 when the first liquid container unit 40 is separated from the housing 21, the first supply tubes 48 inside the case 41 of the first liquid container unit 40 may not be retained while being bent.

Insofar it is possible to increase the amount of displacement of the first liquid container unit 40 relative to the housing 21 by expanding the through hole 47 in the side wall formation member 44 of the first liquid container unit 40 to be larger than the through hole 87 of the side wall portion 82B of the cover member 82, the through hole 47 may expand in an arbitrary direction. For example, the through hole 47 may expand forward further than the through hole 87 of the side wall portion 82B of the cover member 82, or the through hole 47 may expand in at least one of an upward direction and a downward direction.

Insofar as it is possible to guide the first supply tubes 48 into the housing 21, the first supply tubes 48 extending from the first liquid container unit 40, the through hole 87 of the side wall portion 82B of the cover member 82 may be provided at any one of arbitrary positions (for example, the longitudinal center of the side wall portion 82B) other than the front portion of the side wall portion 82B.

The through hole 87 of the side wall portion 82B of the cover member 82 may expand to be larger than the through hole 47 in the side wall formation member 44 of the first liquid container unit 40. When the weight of the first liquid container unit 40 is heavier than that of the recording unit 20, the recording unit 20 may be deformed. In this case, due to the expansion of the through hole 87, the first supply tubes 48 are unlikely to be caught in the circumferential edge of the through hole 87. For this reason, it is possible to displace the recording unit 20 relative to the first liquid container unit 40.

The through hole 67 in the side wall formation member 64 of the second liquid container unit 60 may expand to be larger than the through hole 97 that is provided in the side wall of the housing 21 which faces the second liquid container unit 60. In this configuration, it is possible to increase the amount of displacement of the second liquid container unit 60 relative to the housing 21 in a state where the liquid container body 30 contained in the second liquid container unit 60 remain connected to the relay unit 22 via the first supply tube 68. As a result, it is possible to easily perform maintenance in a state where the second liquid container unit 60 is detached from the housing 21.

At least one of the first dividing member 106 and the second dividing member 107 may be made of another material than metal. In this case, it is possible to obtain the same effects disclosed in (5) and (6).

The integrated cable 52 guided into the housing 21 from the first liquid container unit 40 may not be disposed between the first supply tubes 48 and the second supply tubes 102. For example, the integrated cable 52 may be disposed below the first supply tubes 48, that is, below the space formation member 105. Also, in this case, similar to the first embodiment, it is possible to prevent interference between the integrated cable 52 and the second supply tubes 102 that are deformed in response to a movement of the carriage 23.

Another dividing member than the dividing member 103 may be provided below the first supply tubes 48. In this case, the integrated cable 52 may be provided in a region below the other dividing member, and the first supply tubes 48 and the second supply tubes 102 may be provided in a region above the other dividing member.

Another dividing member than the dividing member 103 may be provided below the second supply tubes 102. In this case, the integrated cable 52 may be provided in a region above the other dividing member, and the first supply tubes 48 and the second supply tubes 102 may be provided in a region below the other dividing member.

Electrical wires other than the integrated cable 52 may be positioned on an opposite side of the region in which the second supply tubes 102 are positioned, while the first dividing member 106 is interposed between the other electrical wires and the region in which the second supply tubes 102 are positioned. For example, the other electrical wires may be electrical wires that are connected to various sensors inside the housing 21, or may be electrical wires that are connected to various actuators (for example, a drive source of a suction pump) inside the housing 21.

As illustrated in FIG. 15, after the second supply tubes 102 are bent rearward, the second supply tubes 102 are connected to the recording head 24. However, when the recording head 24 is positioned the connection portions between the second supply tubes 102 and the relay unit 22, after the second supply tubes 102 are bent upward, the second supply tubes 102 may be connected to the recording head 24.

In the first embodiment, the first supply tubes 48 may be disposed in the region above the dividing member 103, and the second supply tubes 102 may be disposed in the region below the dividing member 103.

The retainer members may not be provided, through which the housing frame 80 supports the second supply tubes 102 between the relay unit 22 and the recording head 24. In this case, the entirety of the second supply tubes 102 are equivalent to portions that follow and are deformed in response to a movement of the carriage 23 in the scanning direction X.

the relay unit 22 may not be provided. In this case, the first supply tubes 48 and 68 connected to the liquid container bodies 30 are directly connected to the recording head 24. In this case, the first supply tubes 48 are routed inside the housing 21 as follows.

Figure 24:
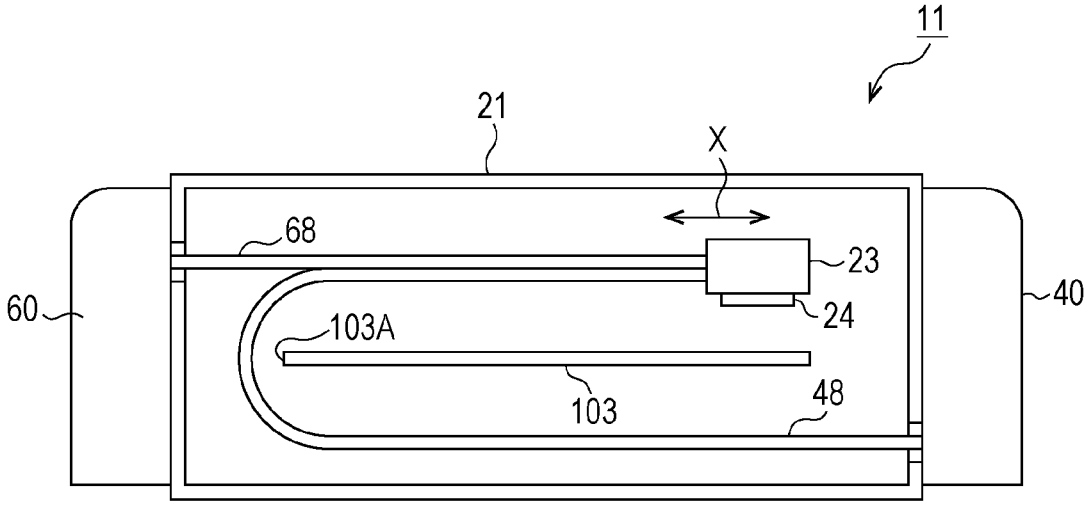
FIG. 24 is a perspective view illustrating a state in which the first supply tubes from the first liquid container unit are routed inside the housing in a recording apparatus according to another embodiment.

That is, as illustrated in FIG. 24, the first supply tubes 48 extend from the first liquid container unit 40 toward the second liquid container unit 60 in a region below the dividing member 103 disposed along the scanning direction X, and are bent upward further than an end portion 103A of the dividing member 103, the end portion 103A being close to the second liquid container unit 60. Then, the first supply tubes 48 return to the first liquid container unit 40 in a region above the dividing member 103, and are connected to the recording head 24.

In this case, the dividing member 103 prevents interference between a portion of the first supply tube 48 which follows and is deformed in response to a movement of the carriage 23, and other portions of the first supply tube 48 when the carriage 23 moves in the scanning direction X. That is, the first supply tubes 48 for supplying ink in the liquid container bodies 30 of the first liquid container unit 40 to the recording head 24 are properly routed inside the housing 21, and thereby when the carriage 23 moves, it is possible to properly deform a part of the first supply tube 48.

The first liquid container unit 40 may be configured such that the number of liquid container bodies 30 is another arbitrary number (for example, one or four) than three, which can be contained therein.

The liquid container body 30 contained in the case 41 may be a refillable liquid container body.

The liquid container body 30 may not be contained inside the cases 41 and 61 attached to the housing 21. In this case, the liquid container body 30 may not have a bag shape, and instead, the liquid container body 30 may have a box shape.

A recording medium may be not only the paper P but also a cloth, a plastic film, or the like.

the recording apparatus may be a liquid ejecting apparatus that records an image or the like on a recording medium by ejecting or discharging liquid other than ink. For example, the recording apparatus may be a liquid ejecting apparatus that records an image or the like on a recording medium by ejecting liquid which contains a material (for example, an electrode material or a coloring material (pixel material) used in manufacturing a liquid crystal display, an electroluminescence (EL) display, a surface-emitting display, or the like) in the form of dispersion or dissolving. The recording apparatus may be a fluid ejecting apparatus that ejects a fluid such as gel (for example, physical gel).

REFERENCE SIGNS LIST

11 RECORDING APPARATUS
21 HOUSING
22 RELAY UNIT
23 CARRIAGE
24 RECORDING HEAD
30 LIQUID CONTAINER BODY
40 FIRST LIQUID CONTAINER UNIT (ONE EXAMPLE OF LIQUID CONTAINER UNIT)
41 CASE
44 SIDE WALL FORMATION MEMBER (ONE EXAMPLE OF SIDE WALL OF CASE)
47 THROUGH HOLE (ONE EXAMPLE OF SECOND THROUGH HOLE)
48 FIRST SUPPLY TUBE (ONE EXAMPLE OF SUPPLY TUBE)
52 INTEGRATED CABLE
61 CASE WHICH IS ONE EXAMPLE OF ANOTHER CASE
68 FIRST SUPPLY TUBE (ANOTHER SUPPLY TUBE)
69 RETAINER
82B SIDE WALL PORTION OF COVER MEMBER (ONE EXAMPLE OF SIDE WALL OF HOUSING)
87 THROUGH HOLE (ONE EXAMPLE OF FIRST THROUGH HOLE)
102 SECOND SUPPLY TUBE (ONE EXAMPLE OF ANOTHER SUPPLY TUBE)
103 DIVIDING MEMBER
106 FIRST DIVIDING MEMBER
107 SECOND DIVIDING MEMBER
P PAPER WHICH IS ONE EXAMPLE OF RECORDING MEDIUM

The entire disclosure of Japanese Patent Application No. 2014- 051286, filed Mar. 14, 2014 is expressly incorporated by reference herein.

The invention claimed is:

1. A recording apparatus comprising:

a recording head which is supported by a carriage that moves back and forth and performs recording by ejecting liquid on a recording medium;

a supply tube which guides liquid in the liquid container body to the recording head and the recording head side thereof is follows and deformed in response to the back and forth movement of the recording head;

a relay unit in the housing; and a dividing member which vertically divides the supply tube, wherein the supply tube has a first portion which is folded back at a position of the dividing member and a second portion which is folded back by the dividing member forward to the head side more than the first portion, follows and is deformed, and wherein the first portion and the second portion are divided by the dividing member, wherein the first portion is a first supply tube which connects the liquid container body and the relay unit, and wherein the second portion is a second supply tube which connects the relay unit and the recording head.

2. A recording apparatus comprising:

a recording head which is supported by a carriage that moves back and forth and performs recording by ejecting liquid on a recording medium;

a supply tube which guides liquid in the liquid container body to the recording head and the recording head side thereof is follows and deformed in response to the back and forth movement of the recording head;

a dividing member which vertically divides the supply tube; and a liquid container unit which has a case containing the liquid container body, wherein an electrical wire connected to the liquid container unit is provided in the dividing member, wherein the supply tube has a first portion which is folded back by the dividing member and a second portion which is folded back at a position of the dividing member forward to the head side more than the first portion, follows and is deformed, and wherein the first portion and the second portion are divided by the dividing member.

3. The recording apparatus according to claim 2, wherein the dividing member have a first dividing member and a second dividing member, and the electrical wire is provided in a gap between the first dividing member and the second dividing member.

4. The recording apparatus according to claim 3, wherein the first dividing member and the second dividing member be made of metal.

5. The recording apparatus according to claim 1, further comprising:

a case which contains the liquid container body, wherein the case is attached to a side wall positioned on one end in the width direction of the recording medium to be recorded in the housing containing the carriage, and wherein the relay unit is provided the other end in the width direction in the housing.

6. The recording apparatus according to claim 5, further comprising:

another case which is provided on the outer side of the housing and on the side opposite to the case interposing the housing therebetween; and another supply tube which supplies liquid in a liquid container body contained in another case to the recording head.

7. A recording apparatus including a housing, a recording head which is supported by a carriage which moves back and forth in a scanning direction in the housing, and performs recording by ejecting liquid on a recording medium, a supply tube which guides liquid in a liquid container body to the recording head, and an electrical wire which routes in the housing, the recording apparatus further comprising:

a dividing member vertically dividing the housing, wherein the supply tube is provided on any one of an upper area and a lower area than the dividing member and the electrical wire is provided on the other area between the upper area and the lower area.

8. The recording apparatus according to claim 7, further comprising: a liquid container unit having the case containing the liquid container body, wherein the electrical wire is guided into the housing from the liquid container unit.

* * * * *